US007643775B2

(12) United States Patent
Löbel

(10) Patent No.: US 7,643,775 B2
(45) Date of Patent: Jan. 5, 2010

(54) METHOD AND DEVICE FOR CONTROLLING THE CIRCULATION SPEED OF AN ENDLESS BELT AND ARRANGEMENT FOR GENERATION OF A BRAKING FORCE ON AN ENDLESS BELT

(75) Inventor: Markus Löbel, Freising (DE)

(73) Assignee: Oce Printing Systems GmbH, Poing (DE)

( * ) Notice: Subject to any disclaimer, the term of this patent is extended or adjusted under 35 U.S.C. 154(b) by 590 days.

(21) Appl. No.: 10/573,400

(22) PCT Filed: Aug. 27, 2004

(86) PCT No.: PCT/EP2004/009582

§ 371 (c)(1),
(2), (4) Date: Nov. 21, 2006

(87) PCT Pub. No.: WO2005/040936

PCT Pub. Date: May 6, 2005

(65) Prior Publication Data

US 2007/0189806 A1 Aug. 16, 2007

(30) Foreign Application Priority Data

Sep. 29, 2003 (DE) ..... 103 45 149

(51) Int. Cl.
*G03G 15/00* (2006.01)
*G03G 15/01* (2006.01)

(52) U.S. Cl. ..... 399/167; 399/302; 399/303; 399/308

(58) Field of Classification Search ..... 399/36, 399/66, 162, 163, 164, 167, 299, 302, 303, 399/308, 313, 329
See application file for complete search history.

(56) References Cited

U.S. PATENT DOCUMENTS 2,831,678 A 4/1958 MacNeil
5,194,896 A 3/1993 Buch et al.

(Continued)

FOREIGN PATENT DOCUMENTS

DE 28 34 167 2/1980

(Continued)

OTHER PUBLICATIONS

Patent Abstracts of Japan—61098373 A May 16, 1986.

*Primary Examiner*—Robert Beatty
(74) *Attorney, Agent, or Firm*—Schiff Hardin LLP

(57) ABSTRACT

In a method for control of circulation speed of an endless belt arranged in a printer or copier, the endless belt is directed over at least two rollers where the belt is driven with a preset first circulation speed via at least one of the rollers as a driven roller. Various load states act on the endless belt in successive operating phases during a printing or copying process, and via said various load states the belt being braked with different strengths so that a slippage is generated at least between the belt and the driven roller. A braking force acting directly on the endless belt is generated. Braking force is controlled such that a substantially constant slippage is generated between the driven roller and the belt based on the operating phases so that the endless belt is braked to a second circulation speed.

19 Claims, 24 Drawing Sheets

U.S. PATENT DOCUMENTS

| | | | | | |
|---|---|---|---|---|---|
| 5,359,401 | A | * | 10/1994 | Uehara et al. | 399/67 |
| 5,943,540 | A | * | 8/1999 | Okamoto et al. | 399/302 |
| 5,987,291 | A | * | 11/1999 | Masuda | 399/302 |
| 6,226,481 | B1 | | 5/2001 | Yoneda et al. | |
| 6,246,856 | B1 | | 6/2001 | Kopp et al. | |
| 6,356,710 | B1 | | 3/2002 | Sato et al. | |
| 6,445,896 | B1 | * | 9/2002 | Satoh | 399/174 |
| 6,771,919 | B2 | * | 8/2004 | Koide | 399/167 |
| 6,853,825 | B2 | * | 2/2005 | Suzuki et al. | 399/167 |
| 6,889,027 | B2 | * | 5/2005 | Tachiki et al. | 399/297 |

FOREIGN PATENT DOCUMENTS

| | | | | |
|---|---|---|---|---|
| DE | 199 42 116 | | | 1/2002 |
| EP | 0 714 161 | | | 5/1996 |
| JP | 04084183 | A | * | 3/1992 |
| JP | 09-026711 | A | | 1/1997 |
| JP | 2000211761 | A | * | 8/2000 |
| JP | 20000-251349 | A | | 9/2000 |
| WO | WO 98/39691 | | | 9/1998 |

* cited by examiner 45
46
47a
48a
v_TFB = v1

49a
47b
48b
v_TFB = v2

49b
47c
48c
v_TFB = v3

49c
47d
48d
v_TFB = v1

A = 545 qcm
V1 = 992 mm/sec 0,00 kVolt (DC)

0,40 kVolt (DC)

0,80 kVolt (DC)

1,20 kVolt (DC)

1,60 kVolt (DC)

METHOD AND DEVICE FOR CONTROLLING THE CIRCULATION SPEED OF AN ENDLESS BELT AND ARRANGEMENT FOR GENERATION OF A BRAKING FORCE ON AN ENDLESS BELT

BACKGROUND

The preferred embodiments concern a method and a device for controlling the circulation speed of an endless belt, in which an endless belt is guided over at least two rollers. The belt is driven by a least one of the rollers with a preset first circulation speed.

In electrophotographic printer or copiers, a print image is electrophotographically generated on a photoconductor, for example an OBC belt (organic photo conductor-photoconductor) in that a charge image is generated on the photoconductor with the aid of a character generator and subsequently developed with toner. The toner image is then transferred onto a belt-shaped intermediate carrier with defined electrical properties. The intermediate carrier can, for example, be a transfer belt.

The toner image located on the intermediate carrier is subsequently directly transferred onto a carrier material (for example a paper web) at a transfer printing station, or the toner image located on the intermediate carrier is re-supplied to the transfer printing region between photoconductor and intermediate carrier in order to print a further (in particular differently-colored) toner image over the toner image already located on the intermediate carrier. This method of printing toner images one over the other is also designated as pick-up of the toner images in a collection mode. The second toner image can, for example, have a toner color different from that of the first toner image or contain a special toner, in particular a machine-readable microtoner. A two-color print with a base color and an additional color can thereby be generated.

Furthermore, printers and copiers are known in which three or four different-colored toner images are printed over one another in order to thereby obtain a print image in full-color printing. During the pick-up of the toner images, the intermediate carrier is pivoted away from the carrier material such that no contact between the intermediate carrier and the carrier material is present during the collection. Only when all toner images are printed over one another on the intermediate carrier is a mechanical contact produced between the intermediate carrier and the carrier material in order to transfer the complete, collected toner image onto the carrier material. The mechanical contact is advantageously established at the point in time at which the leading edge of the toner image located on the intermediate carrier has reached the transfer printing location for transfer-printing of the toner image from the intermediate carrier onto the carrier material. A cleaning station is subsequently pivoted onto the carrier element when the point at which the leading edge of the transferred toner image on the intermediate carrier has been located and has reached the cleaning station.

Corresponding stress states (i.e. load states) of the intermediate carrier thereby result due to the different operating phases, due to which stress states the circulation speed of the intermediate carrier is changed. The operating phases and the load states resulting from these are subsequently explained in further detail in the Figure descriptions regarding FIGS. 1 through 14*b*.

A slippage occurring dependent on the load state results at the drive roller from the different load states. The circulation speed and the circulation time of the intermediate carrier change due to the different slippage at the drive roller. These changes of the circulation speed or circulation time effect a displacement relative to one another of the position of a plurality of successive toner images transferred onto the intermediate carrier as well as the compression of individual toner images or parts of the toner images in the transport direction of the intermediate image carrier.

A print and copier device for performance-adapted monochrome and color one- and two-sided printing of a recording medium is known from the international patent application WO 98/39691 and the U.S. Pat. No. 6,246,856. A plurality of different-colored toner images are thereby generated on a photoconductor belt and subsequently transferred onto a transfer belt on which the toner images are collected before they are transferred all together onto a paper web. The collection and transfer occurs in a start-stop operation of the paper web. In the continuous monochrome printing, the toner images are continuously generated in succession on the photoconductor, and transferred onto the transfer belt whereby the transfer belt in continuous operation directly further transfers a toner image onto the paper web. The contents of the international patent application WO 98/39691 and of the U.S. Pat. No. 6,246,856 are herewith incorporated by reference into the present specification.

Furthermore, in the prior art a plurality of attempts have been made to prevent the position displacement and the length variation of a toner image of the same desired length. It was thus attempted to keep the load change optimally low given the restriction of the transfer belt to a paper web via reduction of the speed difference between paper web and transfer belt. However, depending on the paper properties of the paper web a minimum speed difference is necessary, whereby given a change of the paper type of the paper web to be printed, and in particular of the paper width and the paper thickness, the paper speed, or the speed difference between transfer belt and paper web must be readjusted. An arrangement for reduction load given an activated cleaning unit is known from the German patent document DE 199 42 116 C2. The contents of the patent document DE 199 42 116 C2 as well as the patents or patent applications cited therein is herewith incorporated by reference into the present specification. Due to the arrangement known from this document, the forces acting on the transfer belt which are caused by the cleaning unit are reduced. However, a load change that leads to the disadvantages already described remains upon activation of the cleaning unit.

In the prior art there were also solution approaches to compensate the print image displacement via an adaptation of the write speed by the imaging unit, i.e. by the character generator or the laser exposure device, in that the subsequent position displacement and/or compression or stretching of the toner image is already taken into account in the generation of the latent print image.

Alternatively, solution proposals are known in which the speed-influenced pivot movements occur before or after the toner image generation or after the transfer-printing of the toner image onto the carrier material. However, the overall print speed of the printer is therewith significantly reduced.

SUMMARY

It is an object to specify a method and a device for controlling the circulation speed of an endless belt in which a substantially constant circulation speed of the belt is ensured even given a plurality of different load states.

In a method for control of circulation speed of an endless belt arranged in a printer or copier, the endless belt is directed over at least two rollers where the belt is driven with a preset first circulation speed via at least one of the rollers as a driven roller. Various load states act on the endless belt in successive operating phases during a printing or copying process, and via said various load states the belt being braked with different strengths so that a slippage is generated at least between the belt and the driven roller. A braking force acting directly on the endless belt is generated. Braking force is controlled such that a substantially constant slippage is generated between the driven roller and the belt based on the operating phases so that the endless belt is braked to a second circulation speed.

DESCRIPTION OF THE PREFERRED EMBODIMENTS

Figure 1:
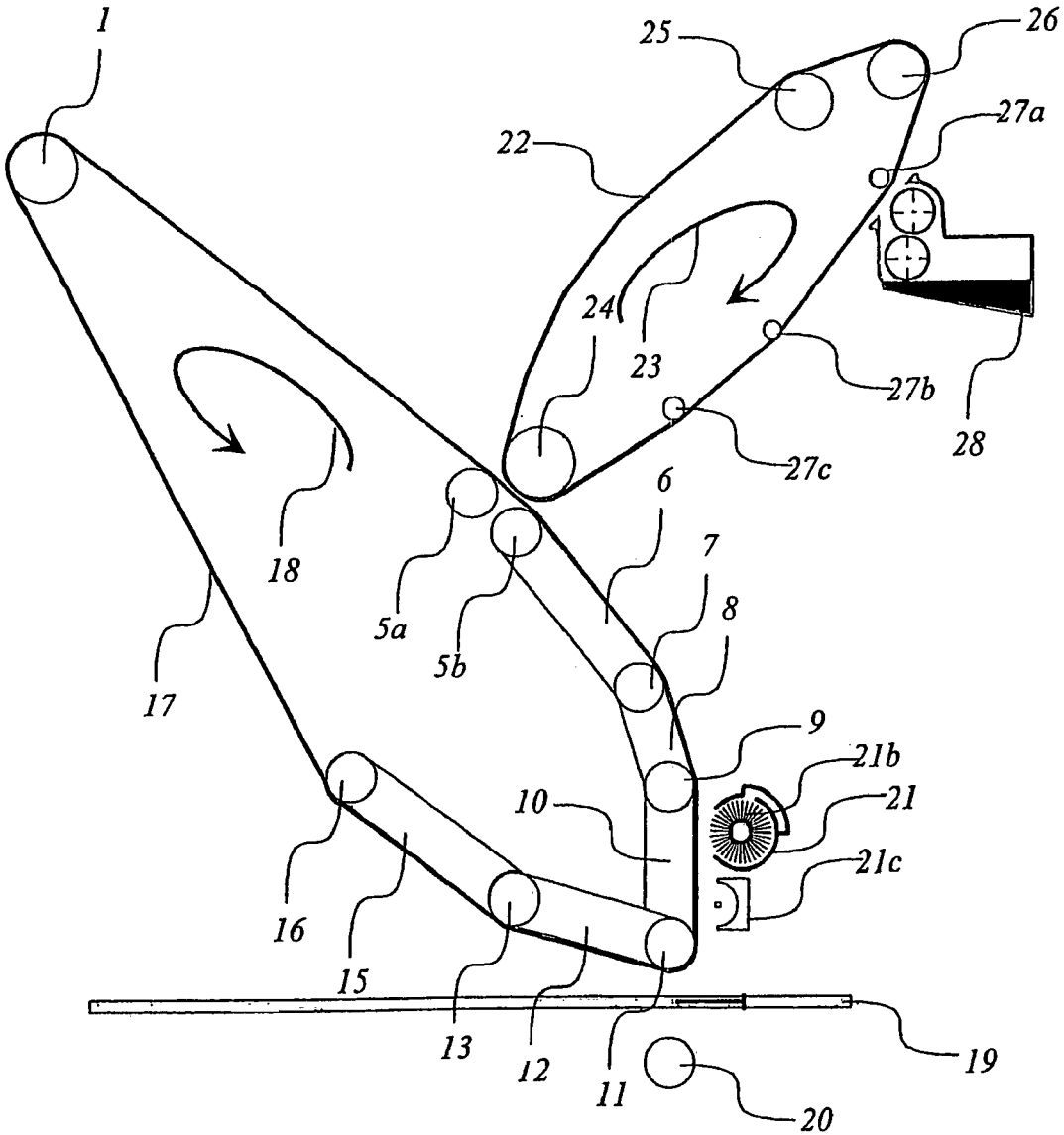
FIG. 1 is a schematic design of a printing unit for generation of a one-color toner image on a carrier material.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Via a method for controlling the circulation speed of an endless belt, it is achieved that the endless belt can be braked to a second circulation speed, which is in particular advantageous when the belt is braked by the method of the preferred embodiment in a phase with lesser load effect and the belt is not braked or is only slightly braked during operating phases with a load effect of components of the printer or copier on the endless belt.

Due to the direct effect of the braking force on the endless belt, inaccuracies and time delays in the generation of a braking effect are prevented.

A second aspect of the preferred embodiment concerns an arrangement for controlling the circulation speed of an endless belt. This arrangement contains an endless belt that is guided over at least two rollers. A drive unit drives the belt over at least one of the rollers with a preset first circulation speed. A braking unit introduces a braking force directly into the belt, via which the belt is braked to a second circulation speed.

Via this arrangement it is achieved that the endless belt is simply brought to the second circulation speed via braking.

A third aspect of the preferred embodiment concerns an arrangement for generation of a braking force on an endless belt. An electrically-conductive surface is arranged essentially parallel to the endless belt. A voltage relative to the ground potential is provided on the surface for generation of a braking force.

Via this arrangement it is achieved that the braking force directly acts on the endless belt, and thus the belt is braked directly and without temporal delays.

A printing unit is shown in FIG. 1 in which a charge image is generated on a photoconductor belt 22 with the aid of a character generator (not shown), which charge image is subsequently inked with colored toner material (advantageously black toner material) with the aid of a developer unit 28. A toner image is thereby generated on the photoconductor belt 22. The photoconductor belt 22 is guided over deflection rollers 24 and 25 as well as over a drive roller 26. Deflection rods 27*a*, 27*b*, 27*c* for direction of the photoconductor belt 22 are also provided.

The drive roller 26 is connected with a drive motor (not shown) and drives the photoconductor belt 22 in the direction of the arrow 23. The printing unit also contains a belt drive for guidance of a transfer belt 17. The belt drive has a drive roller 1 as well as guidance and deflection rollers 1, 5*a*, 5*b*, 7, 9, 11, 13, 16. The rollers 5*a*, 5*b* and 16 are arranged stationary in the belt drive, whereby the guidance and deflection rollers 7, 9, 11, 13 are connected with one another via a lever arrangement with levers 6, 8, 10, 12, 15 such that a pivot movement of the transfer belt 17 onto a paper web 19 and onto a cleaning unit 21 occurs given a constant belt tension of the transfer belt 17. Two drive units (not shown) are also provided for execution of the pivot movements. The transfer belt 17 is driven in the direction of the arrow 18 with the aid of the drive roller 1 that is connected with a drive unit (not shown).

A load-dependent slippage arises at the drive roller 1 upon driving the transfer belt 17 with the aid of the drive roller 1. The different load states in particular occur via pivoting of the transfer belt 17 onto the paper web 19, the pivoting of the transfer belt 17 onto the cleaning unit 21, the activation of the cleaning corotron 21*c* and the pivoting of a pressure roller 20 in the transfer printing region between transfer belt 17 and paper web 19.

The rollers 5*a* and 5*b* are arranged immediately next to a transfer printing location between the photoconductor belt 22 and the transfer belt 17 and continuously press the transfer belt 17 against the photoconductor belt 22 guided to the transfer printing location by the deflection roller 24.

Figure 2:
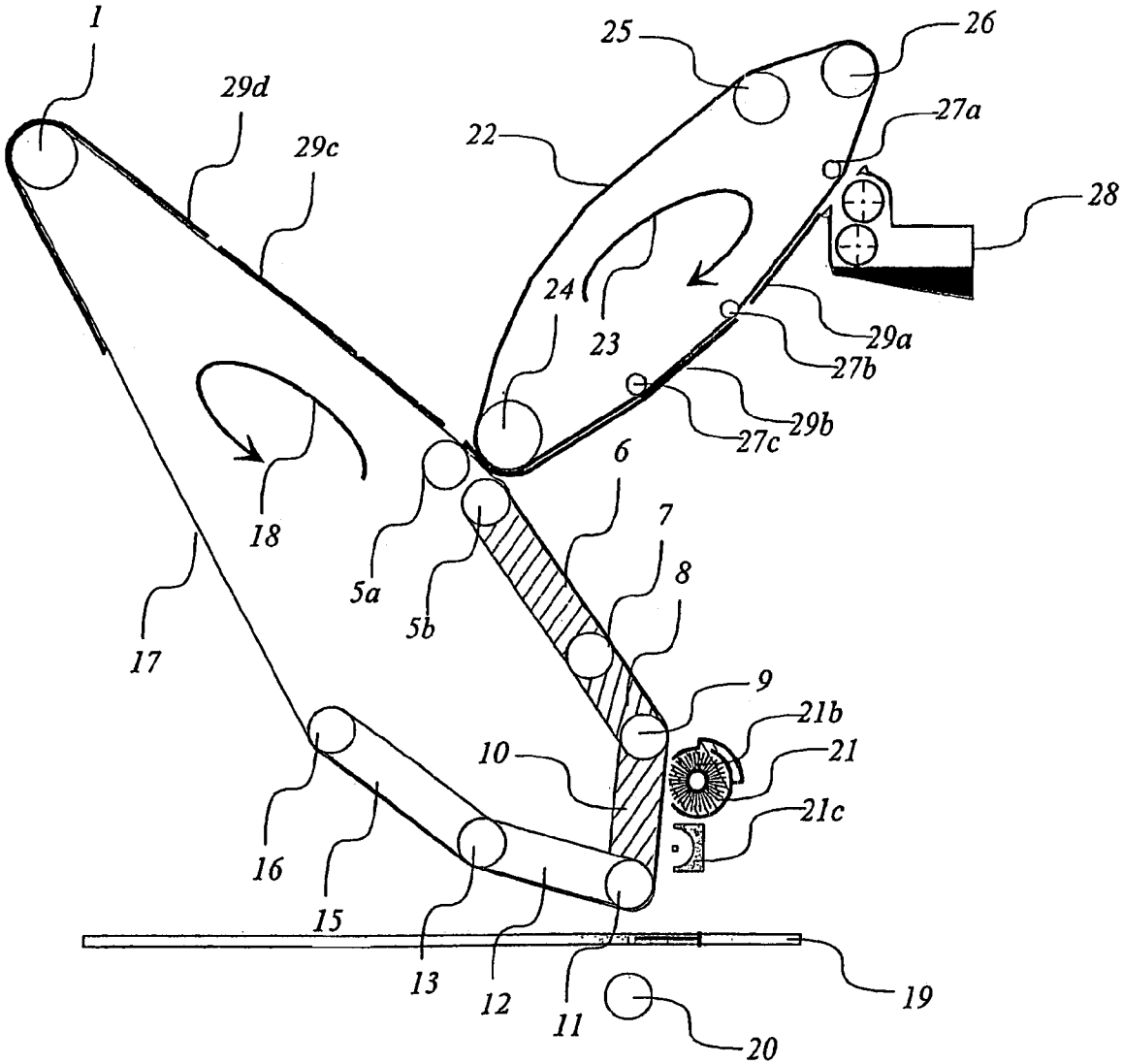
FIG. 2 shows the printing unit according to FIG. 1, whereby a plurality of toner images are shown that are generated on a photoconductor belt and are already partially transferred onto a transfer belt.

The printing unit according to FIG. 1 is shown in FIG. 2, whereby (as described in connection with FIG. 1) toner images are generated via inking of the charge images (generated by a character generator) on the photoconductor belt 22 with toner material via the developer unit 28, which charge images are subsequently transferred onto the transfer belt 17. Two toner images 29*c*, 29*d* are arranged on the photoconductor belt 22 in FIG. 2, whereby a first part of the toner image 29*c* has already been transfer-printed onto the transfer belt 17 and the developer unit 28 subsequently further inks the latent print image (present as a charge image on the photoconductor belt 22) on the toner image 29*d*. The toner images 29*b* and 29*a* inked beforehand by the developer unit 28 have already been transferred onto the transfer belt 17 and are transported in the direction of the arrow 18 with the transfer belt 17 on its surface up to a transfer printing location at which they are then transferred from the transfer belt 17 onto the paper web 19. In the operating phase shown in FIG. 2, the transfer belt 17 is pivoted onto a cleaning unit 21 such that the cleaning unit 21 is activated. The pivoting occurs with the aid of a drive unit (not shown) for movement of the lever 8, whereby the levers 6 and 10 are also moved. The transfer belt 17 is pivoted onto the cleaning unit 21 via this lever movement. The belt tension of the transfer belt 17 always remains constant given the pivot movement of the levers 6, 8, 10. The levers 6, 8 10 participating in the pivot movement are shown hatched in FIG. 2.

Figure 3:
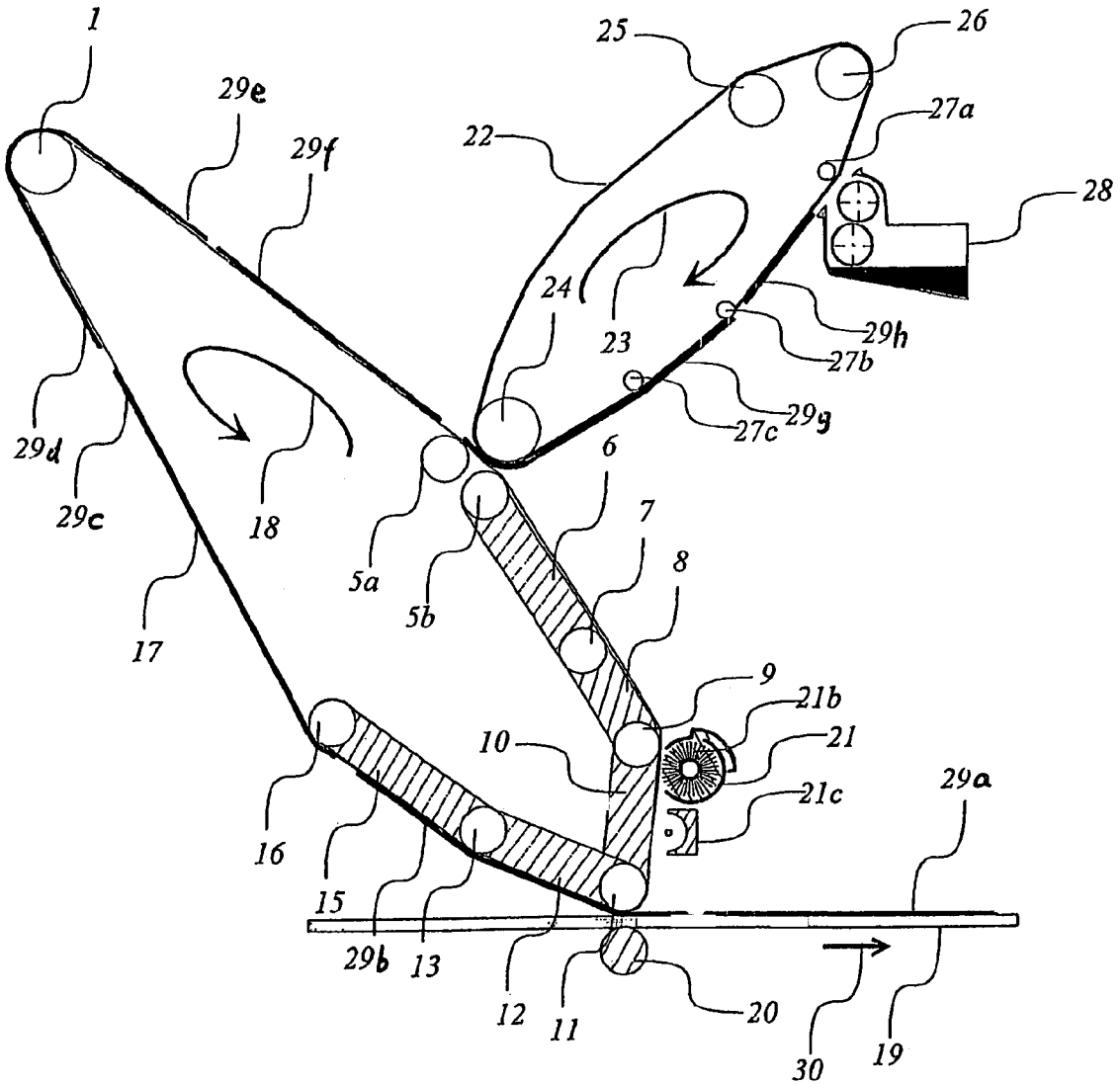
FIG. 3 shows the printing unit according to FIGS. 1 and 2, whereby a part of the generated toner images have already been transfer-printed onto the carrier material.

The printing unit according to FIGS. 1 and 2 is shown in FIG. 3, whereby the transfer belt 17 is pivoted both onto the paper web 19 and onto the cleaning unit 21 such that the toner images 29*b* through 29*f* located on the transfer belt 17 are transferred onto the paper web 19. The paper web 19 is accelerated to transport speed just before the pivoting of the transfer belt 17 and moved in the direction of the arrow 30. The pivot levers 6, 8, 10, 12 and 15 are thereby directed with the aid of drive units such that the transfer belt 17 contacts the paper web 19 in a transfer printing region between the rollers 11 and 20, whereby the pressure roller 20 is pivoted from below onto the paper web 19 simultaneously with the pivoting of the transfer belt 17 onto the paper web 19. The levers 6, 8, 10, 12, 15 participating in the pivot movements are shown with a hatched fill in FIG. 3.

The pivot lever mechanism is moved with the aid of a second drive unit such that the transfer belt 17 is in particular pivoted onto the cleaning unit 21 via the direction of the roller 9, after which at least one part of the first generated toner image 29*h* has been transfer-printed onto the paper web 19 and at least the point of the transfer belt 17 at which the leading edge of the toner image 29*h* was located arrives in the cleaning region of the cleaning unit 21. The cleaning unit 21 contains a discharge corotron 21*c* via whose high voltage corotron the toner residues located on the transfer belt are discharged.

The cleaning unit 21 also contains a brush 21*b* that brushes the toner residues located on the transfer belt 17 off from this, whereby the rotation direction of the cleaning brush 21*b* is provided counter to the transport direction of the transfer belt 17, such that a large brush effect (and thus an efficient cleaning effect) is achieved. With the aid of a suitable device, the toner material removed with the aid of the brush 21*b* is separated from this and re-supplied to the developer unit 28. Alternatively, the brush 21*b* can also move in the opposite direction, for example with a circumferential speed different from the circulation speed of the transfer belt 17. The removed toner material can alternatively be supplied to a residual toner reservoir.

Toner images 29*a*, 29*b*, 29*c*, 29*d*, 29*e*, 29*f*, 29*g*, 29 are shown in FIG. 3 that have been successively inked with the aid of the developer unit 28, whereby toner image 29*a* was inked first and the toner image 29*h* was inked last. The toner image 29*h* has not yet been completely generated and is subsequently further completed via inking of a charge image present on the photoconductor belt 22. As already described, the toner images 29*a* through 29*h* are successively inked on the photoconductor belt 22 with the aid of the developer unit 29, subsequently transferred from this photoconductor belt 22 onto the transfer belt 17 and subsequently transferred onto the paper web 19. The generation of the toner images 29*a* through 29*h* occurs continuously, whereby the photosensitive belt 22, the transfer belt 17 and the paper web 19 are driven with essentially the same speed after the pivoting of the transfer belt 17 onto the paper web 19. To tighten the paper web 19, the drive speed of the transfer belt 17 is slightly higher than the drive speed of the paper web 19. The transfer belt 17 is thereby essentially braked to the drive speed of the paper web 19 after the pivoting onto the paper web 19. The pivoting of the paper web 19 thus effects a speed difference of the circulation speed of the transfer belt 17 due to the lower drive speed of the paper web. A greater slippage at the drive roller 1 of the transfer belt drive is generated by the braking of the transfer belt 17 upon contact with the paper web 19 and the contact pressure of the pressure roller 20.

Figure 4:
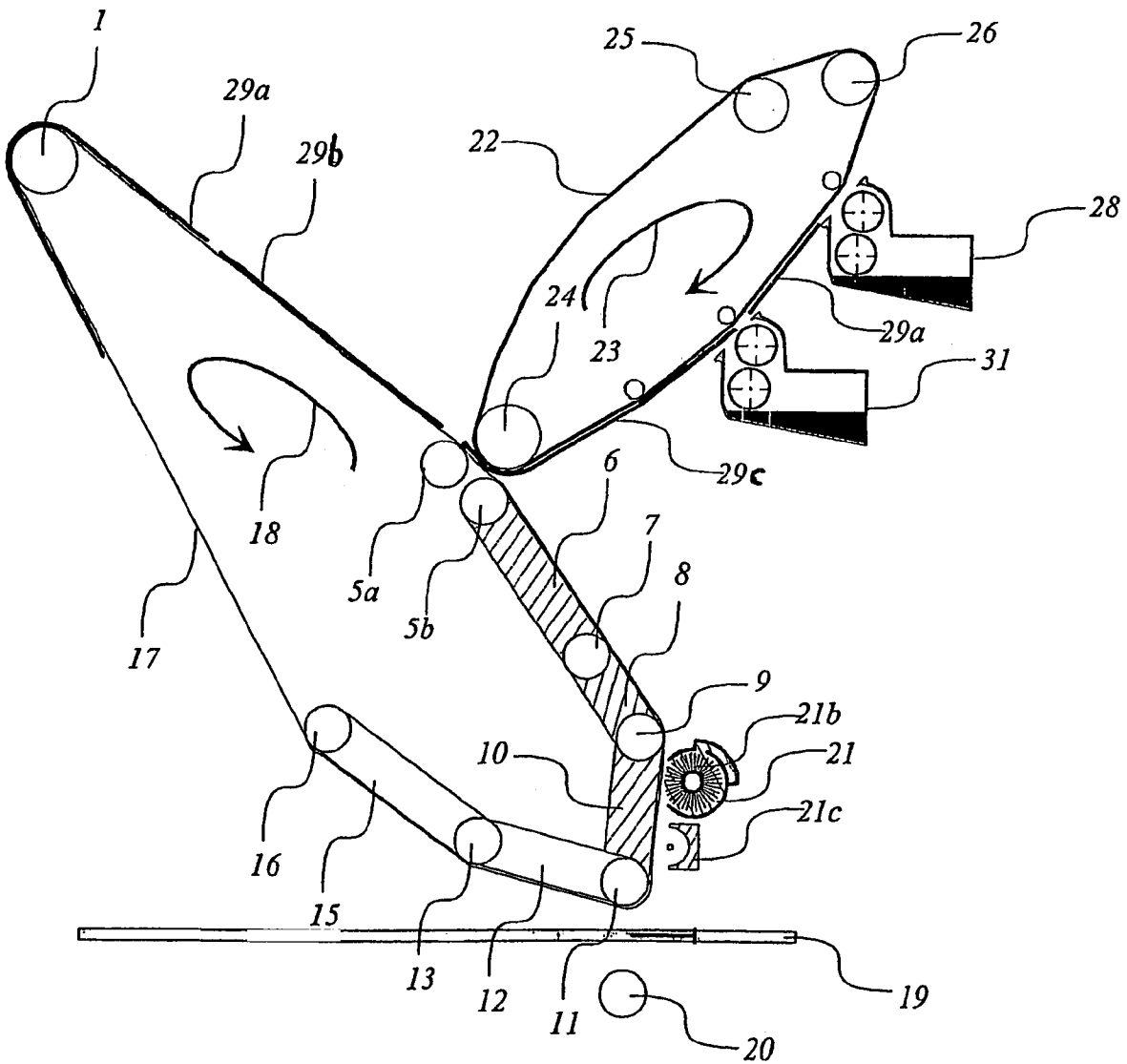
FIG. 4 is a printing unit similar to the printing unit according to FIGS. 1 through 3, whereby two-color print images can be generated with the aid of the printing unit according to FIG. 4.

A printing unit of FIG. 4 is similar to the printing unit according to FIGS. 1 through 3, whereby a two-color toner image can be generated on the paper web 19. Identical elements have identical reference characters. In FIG. 4, four toner images 29*a* through 29*d* have been generated with the aid of the developer unit 28, whereby the toner images are inked with black toner material. Upon inking with toner material of the charge images generated via the character generator, the developer unit 28 is activated and a developer unit 31 for development of toner images with red toner material is deactivated. In the operating phase shown in FIG. 4, the transfer belt 17 is pivoted away from the paper web 19 and onto the cleaning unit 21.

Figure 5:
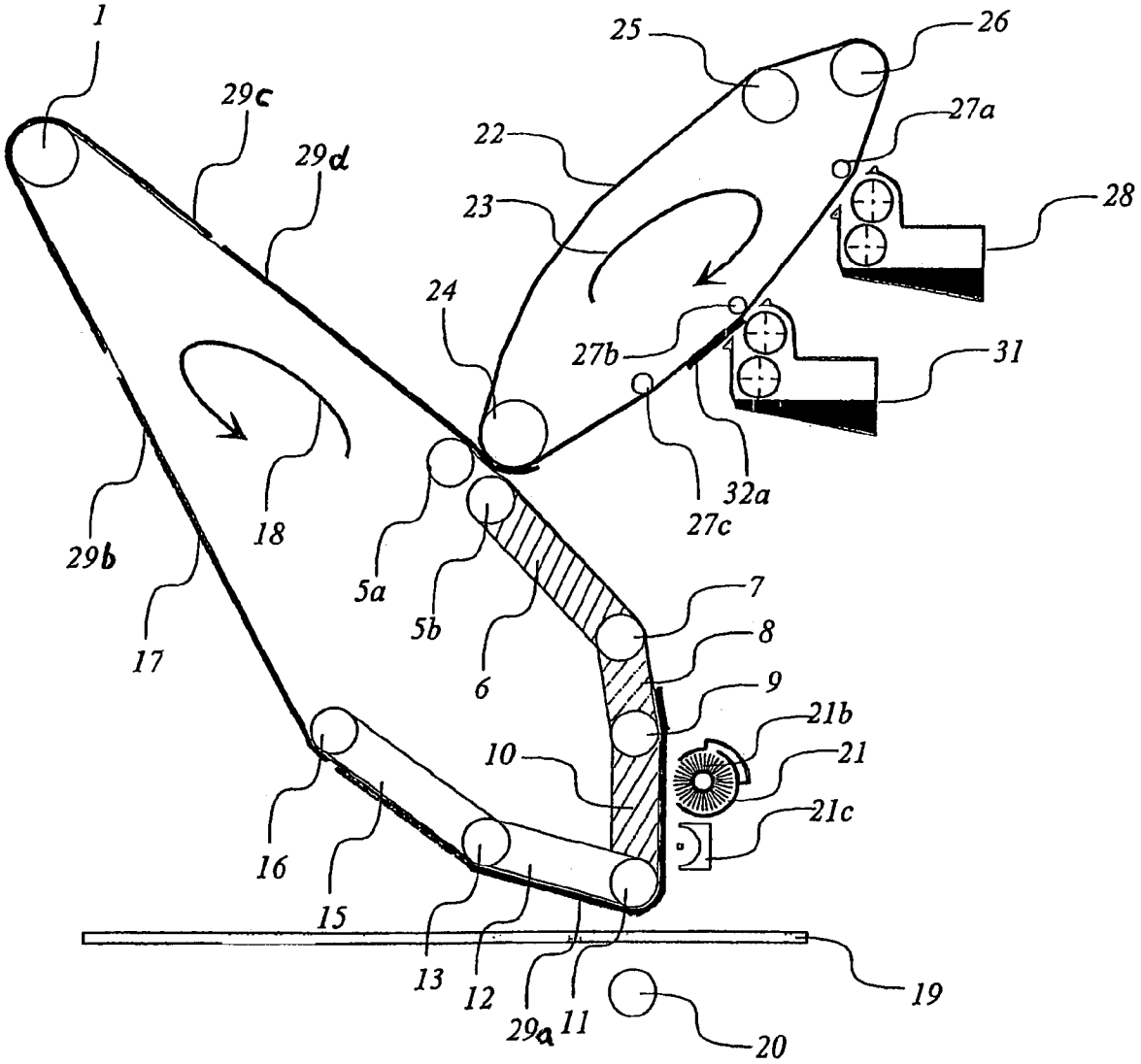
FIG. 5 shows the printing unit according to FIG. 4, whereby (in contrast to FIG. 4) print images are generated in a second color after the generation of print images in a first color.

The printing unit according to FIG. 4 is shown in FIG. 5, whereby the toner image 29*d* has been entirely generated with the aid of the developer unit 28 and has almost completely been transferred from the photoconductor belt 22 onto the transfer belt 17. A further toner image 32*a* has subsequently been generated on the photoconductor belt 22 with the aid of the activated developer unit 31 given a deactivated developer unit 28, whereby the character generator has previously generated a corresponding charge image on the photoconductor belt 22. In the operating state shown in FIG. 5, only a first part of the entire toner image 32*a* is inked with red toner material by the developer unit 31. The further print image of the toner image 32*a* is already located on the photoconductor belt 22 as a charge image and is thus present as a latent print image that is subsequently inked with red toner material with the aid of the developer unit 31.

Figure 6:
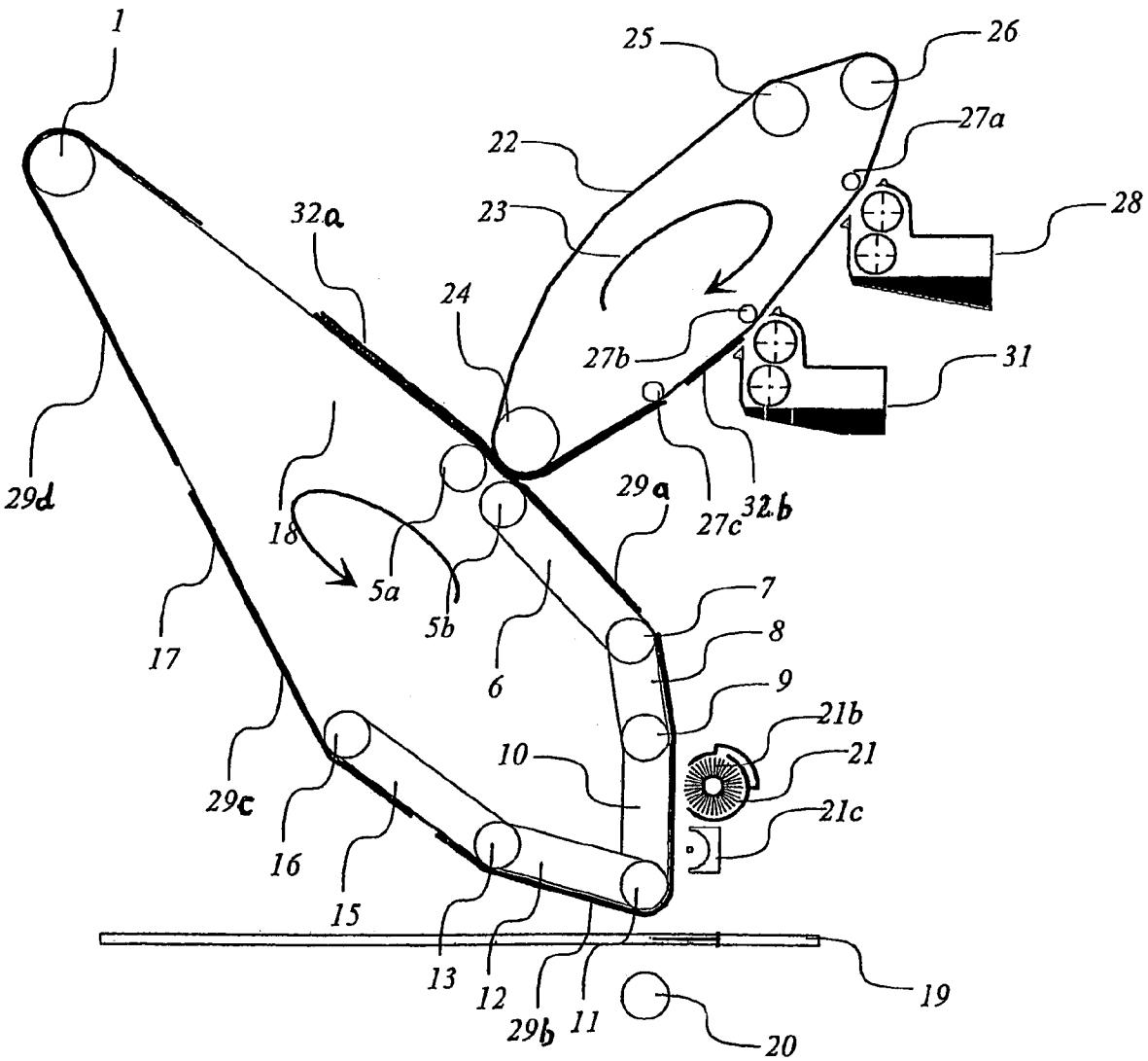
FIG. 6 shows the printing unit according to FIGS. 5 and 6, whereby the print image of a second color is transfer-printed onto the transfer belt over the print image of a first color.

The printing unit according to FIGS. 4 and 5 is shown in FIG. 6, whereby the toner image 32*a* is transfer-printed on the toner image 29*a* that is located on the transfer belt 17 and has been re-supplied to the transfer printing location between the photoconductor belt 22 and the transfer belt 17. The leading edge of the toner image 29*a* coincides with the leading edge of the toner image 32*a* such that the toner images 29*a* and 32*a* are essentially congruent. In the operating state shown in FIG. 6, a further toner image 32*b* has been generated with the aid of the developer unit 31, whereby the separation between the toner images 32*a* and 32*b* essentially corresponds to the separations of the toner images 29*a* and 29*b*; 29*b* and 29*c*; 29*c* and 29*d*. The printing unit according to FIG. 6 thus has generated a second red toner image 32*a* on the black toner image 29*a*.

Figure 7:
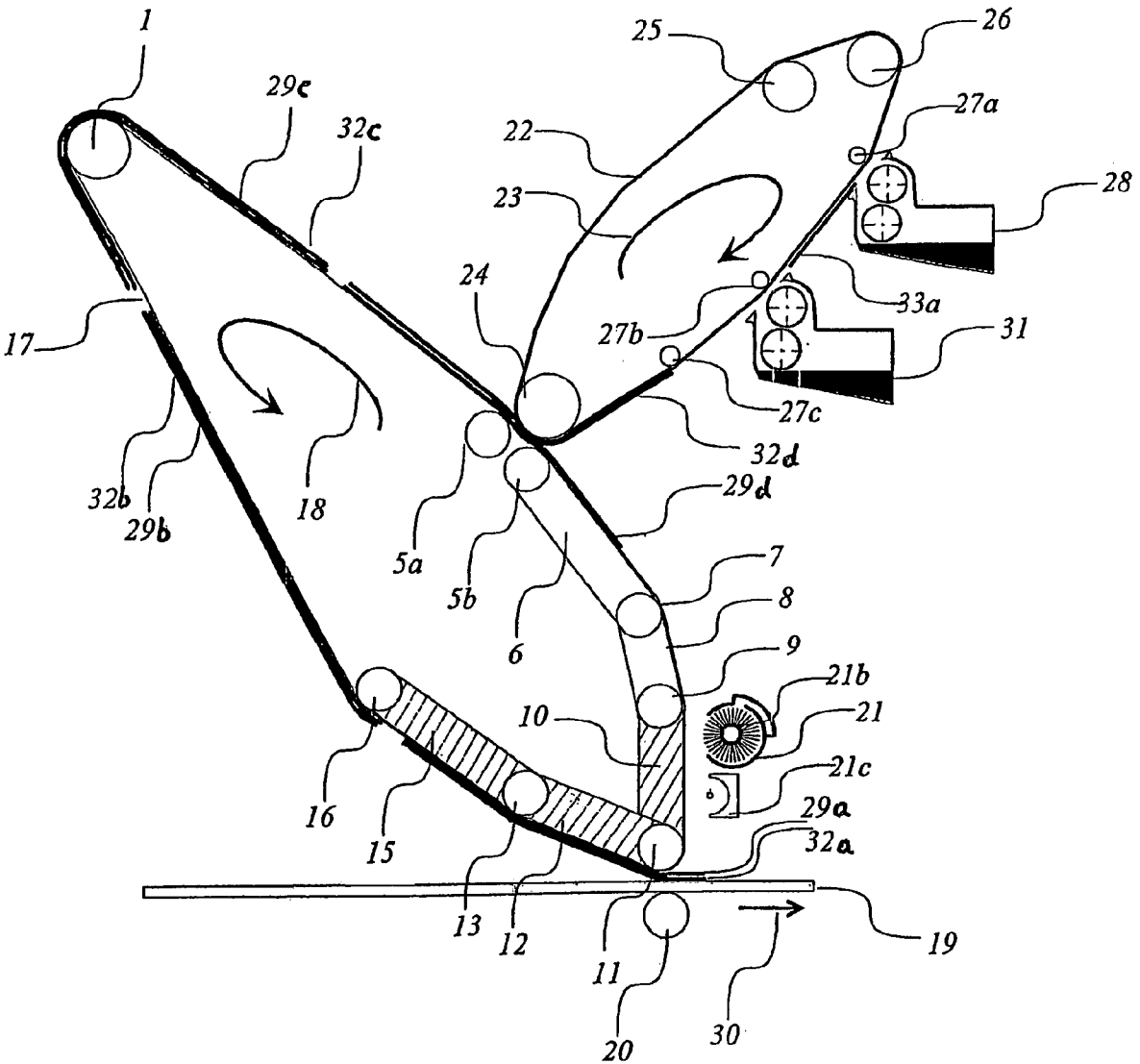
FIG. 7 shows the printing unit according to FIGS. 4 through 6, whereby the transfer belt is pivoted onto the carrier material for transfer printing of a two-color toner image.

The printing unit according to FIGS. 4 through 6 is shown in FIG. 7, whereby after the pivoting of the transfer belt 17 onto the paper web 19 with the aid of the levers 10, 12 and 15, a first part of the toner images 29*a* and 32*a* printed over one another have been transferred onto the paper web 19. The pressure roller 20 is pivoted onto the paper web 19 from below simultaneously with the pivoting of the transfer belt 17 onto the paper web 19. The paper web 19 has been accelerated to transport speed before both pivoting processes, as is described in connection with FIGS. 1 through 3 for the printing unit shown there.

Further toner images 32*a*, 32*c*, 32*d* were generated in a red toner color with the aid of the developer unit 31 and are essentially congruent in the outer dimensions with the toner images previously inked black with the aid of the developer unit 28. The toner image 32*a* is superimposed on the toner image 29*a*, the toner image 32*c* is superimposed on the toner image 29*c* and the toner image 32*d* is superimposed on the toner image 29*d*. This superimposition of the toner images is also designated as pick-up. The generation of the toner images placed atop one another thus occurs in a collection mode. In the operating state shown in FIG. 7, the transfer belt 17 is not yet pivoted onto the cleaning unit 21 since the point at which the leading edge of the toner images 29*a* and 32*a* has been located has not yet reached the cleaning region in the cleaning unit 21.

In FIG. 7, a further toner image 33*a* has been generated with black toner material on the photoconductor belt 22 with the aid of the developer unit 28.

Figure 8:
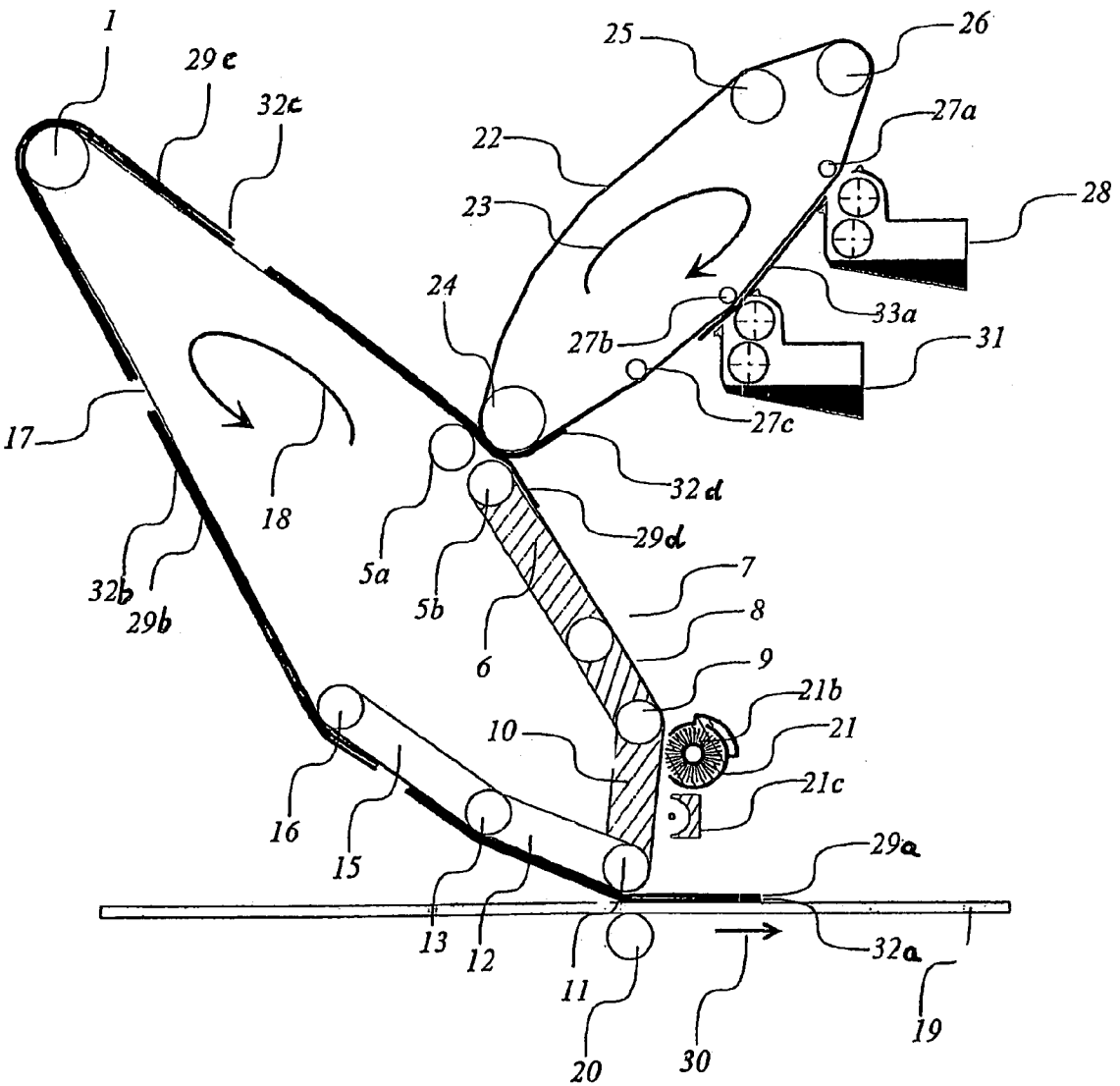
FIG. 8 shows the printing unit according to FIGS. 4 through 7, whereby the transfer belt has been pivoted onto a cleaning unit after the beginning of the transfer printing of the two-color toner image.

The printing unit shown according to FIGS. 4 through 7 is shown in FIG. 8, whereby a further part of the toner images 29*a* and 32*a* has been transferred onto the paper web 19. The point at which the leading edge of the toner images 29*a* and 32*a* has been located has reached the cleaning region of the cleaning unit 21, whereby the pivot levers 6, 8 and 10 are moved (at the latest upon arrival at this point of the transfer belt 17 in the cleaning region of the cleaning unit 21) with the aid of a drive unit (not shown) such that the transfer belt 17 is pivoted onto the cleaning unit 21, whereby the positions of the pivot levers 12 and 15 are not altered upon pivoting of the transfer belt 17 onto the cleaning unit 21. The belt tension of the transfer belt 17 is also not changed both upon pivoting of the transfer belt 17 onto the paper web 19 and upon pivoting of the transfer belt 17 onto the cleaning unit 21.

A printer for performance-adapted monochrome and color one- and two-sided printing of a recording medium is known from WO 98/39691 and the U.S. Pat. No. 6,246,856, whereby the pivoting of the transfer belt onto and off of the recording medium is described in detail in this patent application or in this patent. The content of the patent application WO 98/39691 and the content of the U.S. Pat. No. 6,246,856 are herewith incorporated by reference into the present specification.

Figure 9:
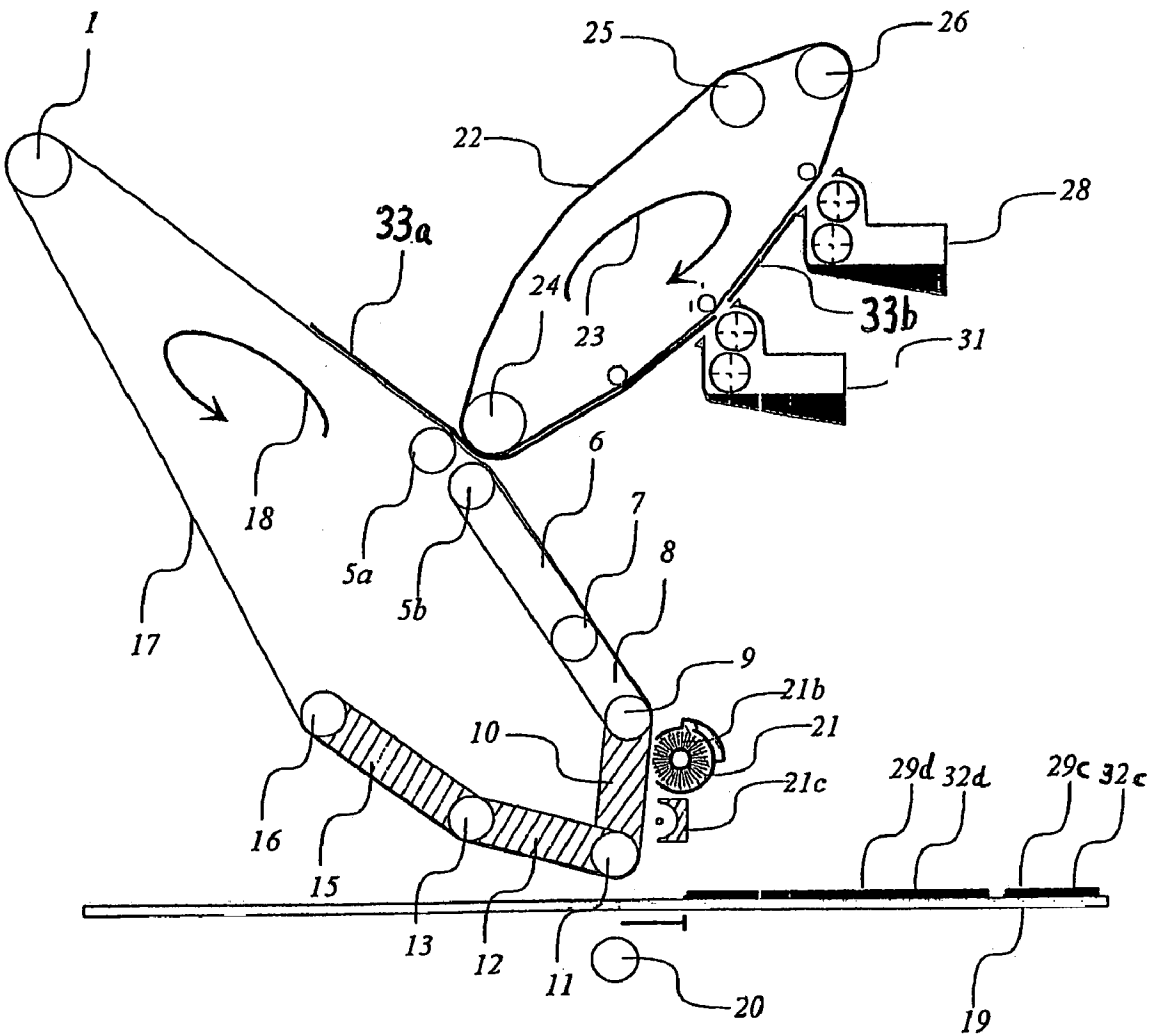
FIG. 9 shows the printing unit according to FIGS. 4 through 8, whereby the transfer belt is pivoted away from the carrier material again after the transfer printing of the two-color toner image.

The printing unit according to FIGS. 4 through 8 is shown in FIG. 9, whereby the entire toner images shown collected (i.e. printed over one another) in FIG. 8 have been transferred to the paper web 19. The trailing edge of the print images 29*d*/32*d* were transferred last onto the paper web 19. After the trailing edges of these toner images 29*d*/32*d* have been transferred onto the paper web 19, the transfer belt 17 has been pivoted away from the paper web 19 with the aid of the drive device (not shown) via movement of the levers 10, 12 and 15. Furthermore, both the discharge corotron 21*c* and the cleaning brush 21*b* are activated, whereby the transfer belt 17 is furthermore pivoted onto the cleaning unit 21. The cleaning brush 21*b* and the cleaning corotron 21*c* remain activated at least until the point on the transfer belt 17 at which the trailing edges of the toner images 29*d*/32*d* located on the transfer belt 17 has completely passed through the cleaning region of the cleaning unit 21. The toner image 22*a* already generated in the operating mode or operating state already shown in FIG. 8 is at least partially transferred from the photoconductor belt 21 onto the transfer belt 17. A further toner image 33*b* is generated on the photoconductor belt 22 with the aid of the developer unit 28. Both the toner image 22*a* and the toner image 33*b* have been inked with the toner material in the color black.

Figure 10:
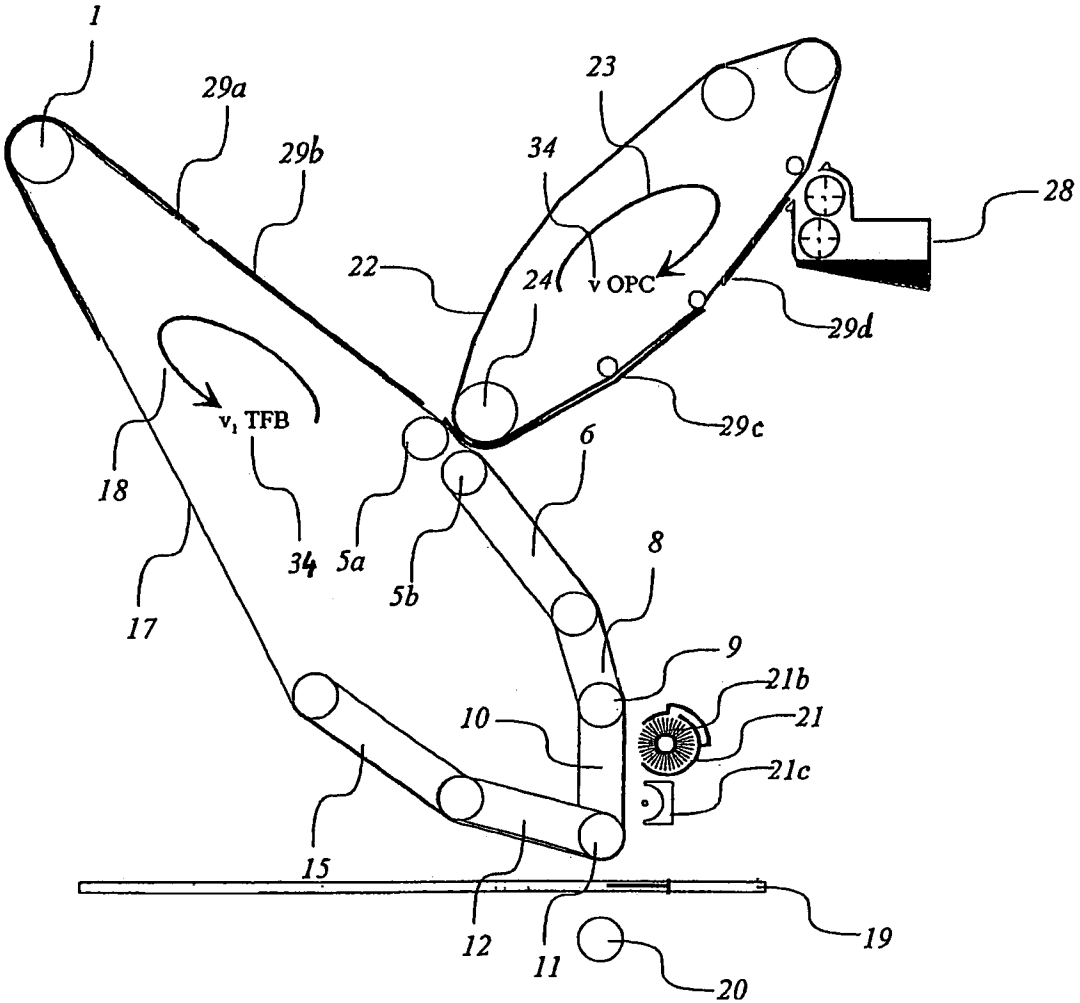
FIG. 10 shows the printing unit according to FIGS. 1 through 3, whereby the printing unit is shown in a first operating phase.

The printing unit according to FIGS. 1 through 3 is shown in FIG. 10, whereby in contrast to the operating states shown in FIGS. 1 through 3 the printing unit is shown in an operating state in which print images 29*a* through 29*d* are transported on the photoconductor belt 22 and the transfer belt 17, whereby the transfer belt 17 is pivoted away from the cleaning unit 21 an the paper web 19. A load state of the transfer belt 17 similar to the load state according to Figure is thus shown in FIG. 10, whereby in contrast to the load state according to FIG. 1 toner images 29*a* through 29*d* are generated or transported. No braking effect is thereby exerted on the transfer belt 17 due to the contact of the transfer belt 17 with the cleaning unit 21 and no braking effect is exerted on the transfer belt 17 due to the contact of the transfer belt 17 with the paper web 19. The toner images 29*a*, 29*b* and 29*c* transferred from the photoconductor belt 22 onto the transfer belt 17 have thus been transferred at a higher first circulation speed $v_1$ of the transfer belt 17 according to FIG. 10. Given the load state according to FIG. 2 in which the transfer belt 17 is pivoted onto the cleaning unit 21, at least the toner image 29*c* is transferred from photoconductor belt 22 onto the transfer belt 17 at a second middle circulation speed $v_2$ of the transfer belt 17. Given a transfer belt 17 pivoted onto the paper web 19 and onto the cleaning unit 21, at least the toner image 29*c* in FIG. 3 is transferred onto the transfer belt 17 at a third low circulation speed $v_3$ of the transfer belt 17.

The circulation speed of the photoconductor belt 22 is thereby constant, independent of the circulation speed of the transfer belt 17. The toner images are thereby not transferred and compressed at the first circulation speed $v_1$ of the transfer belt 17 at the transfer printing location between photoconductor belt 22 and transfer belt 17, meaning that the length of the toner images on the photoconductor belt 22 corresponds to the subsequent length of the same toner images on the transfer belt 17. If the toner images are transferred from the photoconductor belt 22 onto the transfer belt 17 at middle circulation speed $v_2$, the toner image is compressed by a first amount upon transfer and is compressed by a second amount upon transfer of a toner image at the third, lower circulation speed $v_3$ of the transfer belt 17.

The toner images are thereby compressed in a range between a thousandth and multiple millimeters. This affects the length of the subsequent print image generated on the paper web 19 as well as its position on the paper web 19. Given the load state according to FIG. 10, the circulation of the transfer printing 17 occurs with a first high circulation speed $v_1$ that is additionally designated in FIG. 10 with the reference character 34. The speed v of the photoconductor belt 22 is also additionally designated with the reference character 35.

Figure 11:
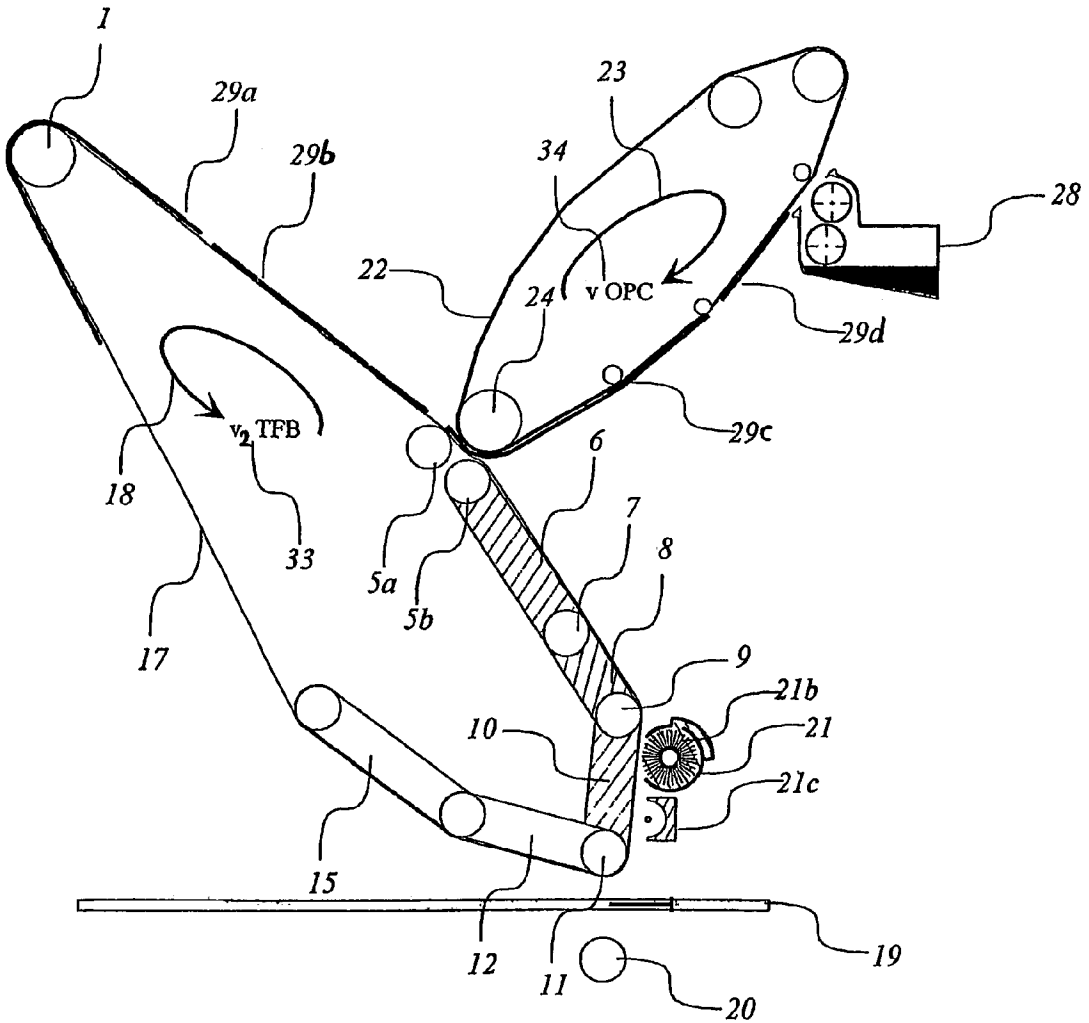
FIG. 11 shows the printing unit according to FIG. 10, whereby the transfer belt is pivoted onto the cleaning unit.

The printing unit according to FIG. 10 is shown in FIG. 11, whereby the print images 29*a* through 29*d* have been generated in the same manner as in FIG. 10, whereby, however, the transfer belt 17 is pivoted onto the cleaning unit 21 with the aid of the levers 6, 8 and 10 at least upon transfer of the toner image 29*c* from the photoconductor belt onto the transfer belt 17. Due to the pivoted cleaning unit 21, the circulation of the transfer belt 17 occurs with the second, middle circulation speed $v_2$, whereby in FIG. 11 the middle circulation speed $v_2$ is additionally designated with the reference character 33.

Figure 12:
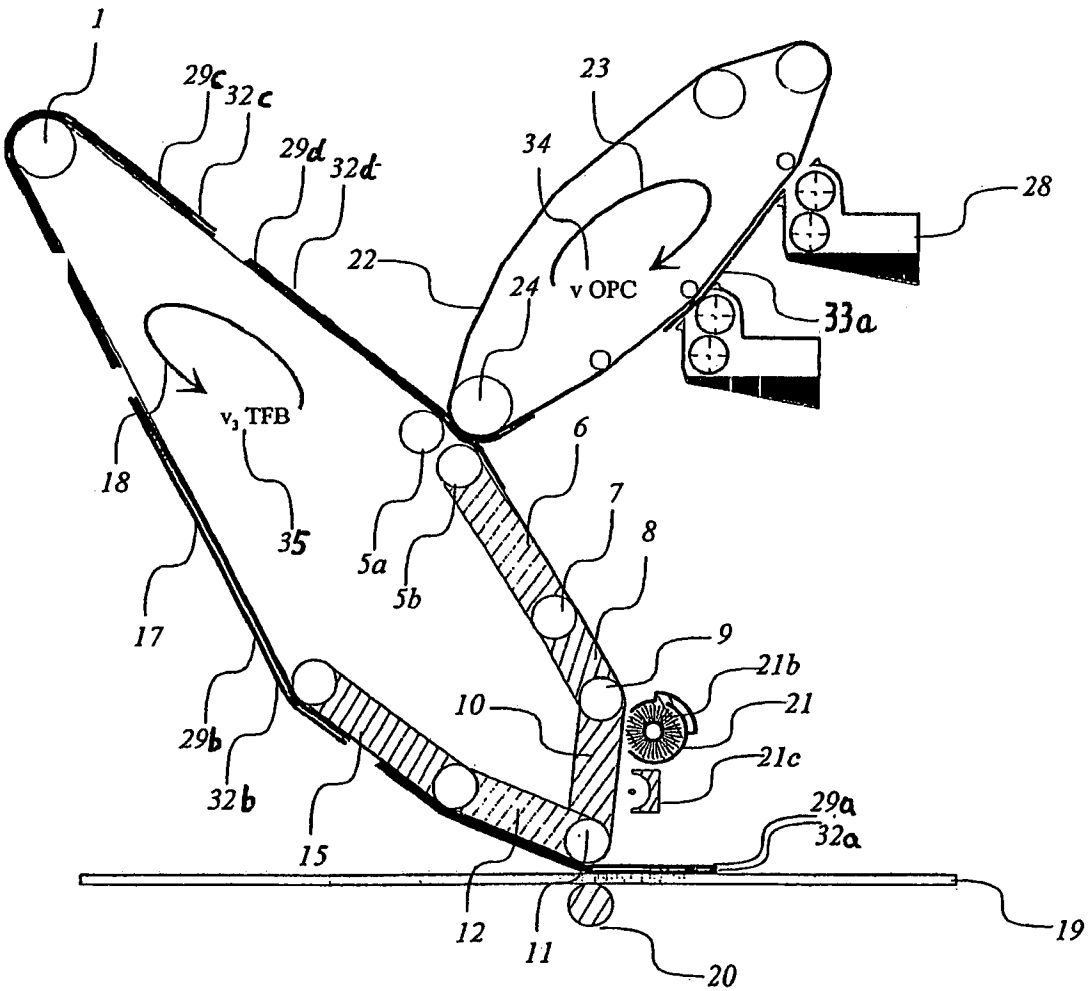
FIG. 12 shows the printing unit according to FIGS. 4 through 9, whereby the transfer belt is pivoted onto the paper web as well as onto the cleaning unit in the shown operating phase, and additionally a pressure roller is pivoted onto the paper web at the pressure point.

The printing unit according to FIGS. 4 through 9 is shown in FIG. 12, whereby the transfer belt 17 is pivoted both onto the cleaning unit 21 and onto the paper web 19. The pressure roller 20 is also pivoted onto the paper web 19 from below. The circulation of the transfer belt 17 thereby occurs with a lower third circulation speed $v_3$ that is additionally designated with the reference character 35 in FIG. 12.

Figure 13:
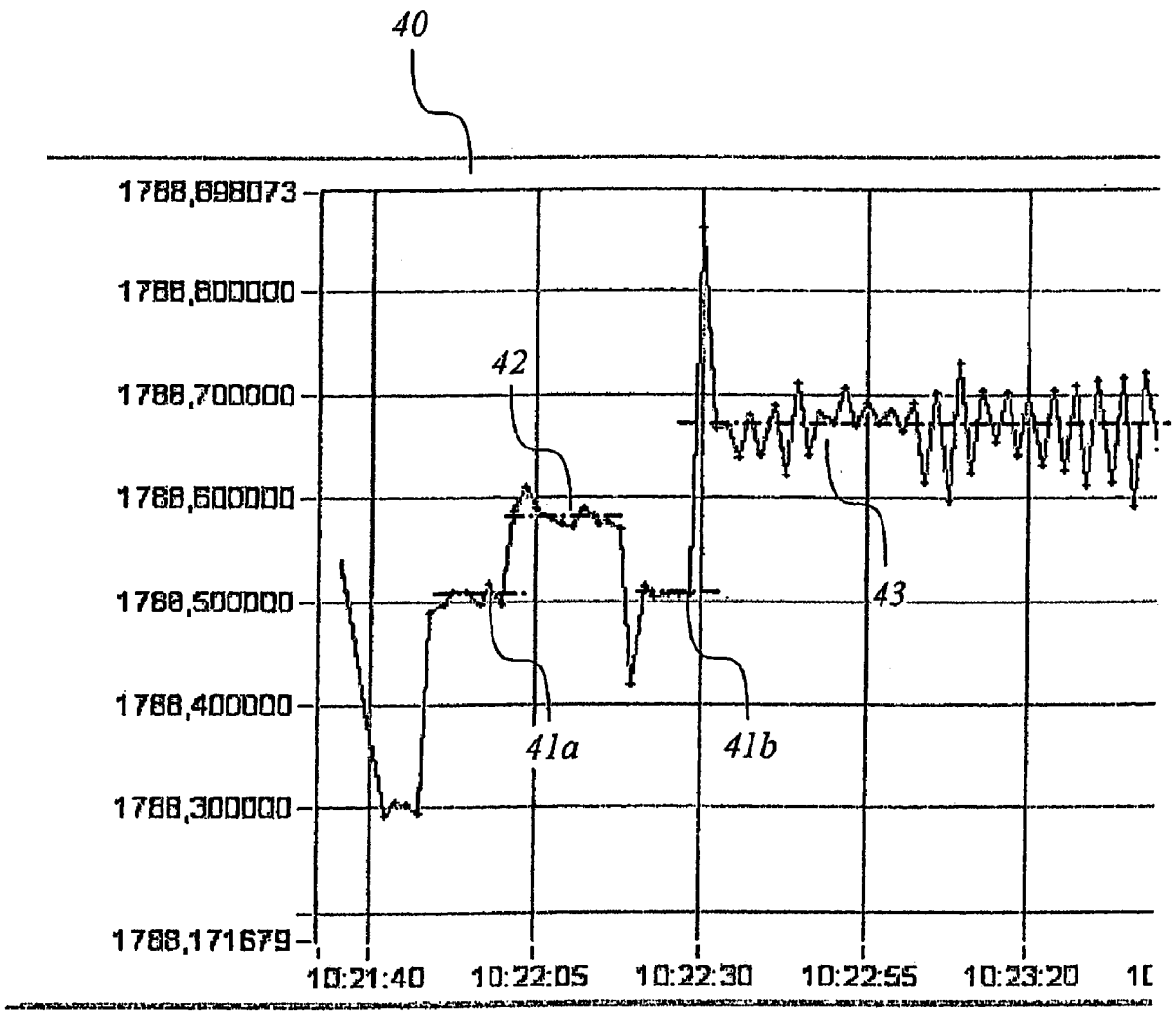
FIG. 13 is a circulation time-time diagram in which circulation times of various operating phases are shown.

A circulation time diagram 40 is shown in FIG. 13 as a screen printout of an evaluation software for evaluation of measurement values determined with the aid of a unit on the printing unit according to one of the printing units shown in FIGS. 1 through 12. The current time is thereby plotted on the abscissa and the circulation time of a belt circulation of the transfer belt 17 is plotted on the ordinate. In the diagram 40, the circulation speeds $v_1$, $v_2$ and $v_3$ of the transfer belt 17 during the operating states shown in FIGS. 10 through 12 have been determined. During the operating states 41*a* and 41*b*, the transfer belt 17 has neither mechanical contact with the cleaning unit 21 nor mechanical contact with the paper web 19. In these operating states, the transfer belt 17 has a circulation time of 1788.51 ms, which corresponds to the circulation speed $v_1$. During the operating state 42, the transfer belt 17 has mechanical contact with the activated cleaning unit 21, however no mechanical contact with the paper web 19. During the operating state 42, the transfer belt 17 has a circulation time of 1788.58 ms, which corresponds to a speed $v_2$.

During the operating state 43, the transfer belt 17 has both mechanical contact with the cleaning unit 21 and mechanical contact with the paper web 19. During the operating state 43, the transfer belt 17 has a circulation speed of 1788.67 ms and thus a speed $v_3$. The circulation speed of the transfer belt 17 thereby varies between the speeds $v_1$ through $v_3$. The circulation speed of the photoconductor belt 22 always remains constant during the operating phases 41*a*, 41*b*, 42 and 43. The circulation time of the transfer belt 17 results from the quotient of the length of the transfer belt 17 and the circulation speed of the transfer belt 17.

In the printing units according to FIGS. 1 though 12, the relative speed deviation is less than 2/1000 of the nominal circulation speed. However, in practice (in particular in two-color and multi-color printing) it has visible effects. With the aid of the printing units according to FIGS. 1 through 12, one page or multiple pages with a total length of up to 1650 mm can be generated in an exemplary design embodiment of these printing units. After the load-conditional reduction of the circulation speed of the transfer belt 17 by (relatively) 1/1000 of the circulation speed after the transfer printing of a first toner image and before the transfer printing of a second toner image, the second toner image transferred from the photoconductor belt 22 onto the transfer belt 17 is compressed by 1z,900 relative to the first toner image during this transfer such that, given a congruent start of the page by both toner images, the page end of the second toner image ends earlier than the page end of the first toner image.

Given a write length of the first color separation of 1650 mm, i.e. given a toner image with a length of 1650 mm in a first toner color, and given a compression of the subsequent printing of a second toner image in a second color on this first toner image, the second toner image is shorter by 1.65 mm than the first toner image (1z,900 of 1650 mm write length of the first circulation).

A second toner image transferred at a higher circulation speed (in comparison to a first circulation speed) is expanded in the same manner in relation to the first toner image. The relative speed difference results from the quotients of the speed $vx_1$ at which the first toner image is transferred and the speed $vx_2$ at which the second toner image is transferred, whereby the amount 1 is subtracted from this quotient. The absolute length error dl results from the multiplication of the write length possible on the transfer belt 17 and the relative speed difference.

The product from 1650 mm×0.01=1.65 mm thus results in the present example for calculation of the length error, whereby a positive algebraic sign of the length error results given a speed increase and a negative algebraic sign of the length error results given a speed reduction. The human eye very clearly detects a line offset given a plurality of print images of different colors printed over one another and feels this to be disturbing, whereby this offset is generally designated as color fringe in printing technology. 2/100 mm offset is thereby already clearly detectable and is sensed as disturbing. It results from this that, given a possible length of a print image printed over one another of 1650 mm, the speed change may maximally amount to 0.012z,900 , whereby this value is calculated as follows:

$$\text{Allowable speed change} = \frac{0.020\,\text{mm}}{1650\,\text{mm} \times 1000\%} = 0.012\%:$$

Figures 14A, 14B, 14C, 14D:
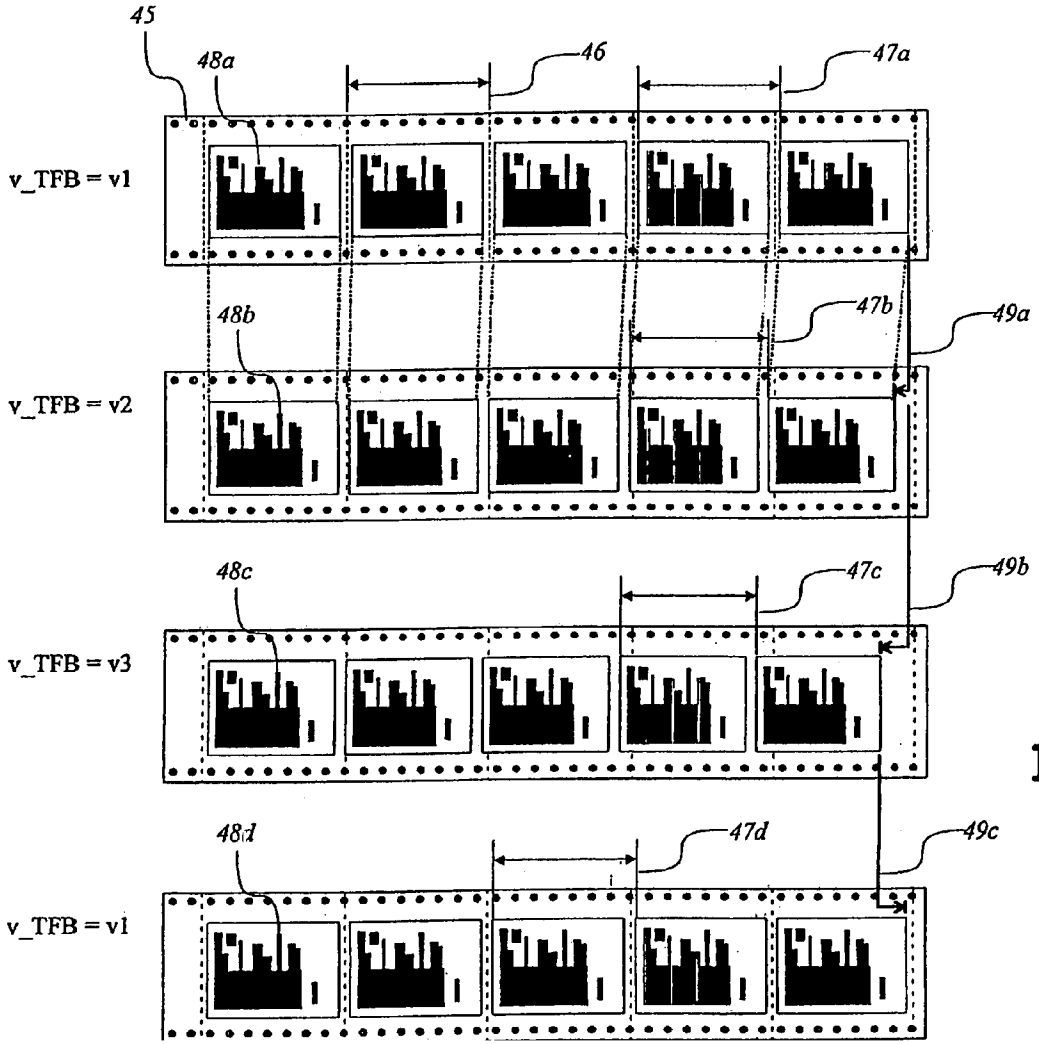
FIGS. 14*a* through 14*d* show position changes of print images as a consequence of different circulation times.

The effects of the compression of the print images at the transfer printing location between photoconductor belt 22 and transfer belt 17 are shown in FIGS. 14*a* through 14*d* using schematically shown print sides 48*a* through 48*d*. Five print images of print sides that are successively generated and transferred onto the transfer belt 17 are shown in FIG. 14*a*, which print sides are subsequently transfer-printed onto an endless paper web 45. In contrast to this, the second color printout that is designated with 48*b* in FIG. 14*v* was transferred onto the transfer belt 17 with a circulation speed $v_2$ of the transfer belt 17 after the pivoting of the cleaning unit 21, whereby the print sides shown in FIG. 14*b* should at least correspond in the outer contours to the print sides according to FIG. 14*a*. However, the length of the print sides is different due to the different circulation speed $v_1$, $v_2$ of the transfer belt 17, i.e. due to the difference of the speeds $v_1$ and $v_2$. The second toner image according to FIG. 14*b* is also generated in second toner color differing from the toner image according to FIG. 14*a*. The transfer belt 17 has an even lower circulation speed $v_3$ after the pivoting of the transfer belt 17 onto the paper web 19, 45.

The transfer belt 17 is subsequently pivoted away from both the paper web 19 and the cleaning unit 21, such that the transfer belt 17 again has a circulation speed $v_1$. The subsequently generated print images are then again transferred uncompressed from the photoconductor belt 22 onto the transfer belt 17. The change of the total length of the five successively-generated print sides of 1650 mm given a change of the circulation speed of the transfer belt 17 from the circulation speed $v_1$ to the circulation speed $v_2$ is designated by the arrow 49*a*; the offset given a change of the circulation speed $v_1$ to the circulation speed $v_3$ is designated with the arrow 49*b*; and the offset given the change of the circulation speed $v_3$ to the circulation speed $v_1$ is designated with the arrow 49*c*.

The physical length of one page on the paper web 45 is specified with the aid of the dimensioning, the physical length of the toner image transferred onto the transfer belt 17 (which toner image is transferred onto the paper web 17 after the collection of the toner images on the transfer belt 17) is respectively specified with the dimensions 47*a* through 47*d*. In FIGS. 14*a* through 14*d*, the physical page lengths are respectively specified by perpendicular dashed lines.

The offset of the toner images generated or transfer-printed at the circulation speed $v_1$ in relation to the toner images generated or transfer-printed at the speed $v_2$ is clarified by the dash-dot lines indicated between the print images of FIGS. 14*a* and 14*b*, whereby the offset between the individual print images is clarified via the increasing slope of the initially horizontal dash-dot line in successive print image starts and ends. In FIG. 14*b* it is likewise visible that the third print image is already transfer-printed onto the paper web 45 before the physical page border, whereby a part of the toner image of this print page is truncated in a subsequently cutting process. Larger parts of the print page are then truncated in the subsequently printed fourth and fifth print pages, whereby parts of the subsequent print page are respectively contained on the preceding print page according to the layout.

In the solution of the preferred embodiment to the problem, the individual influences that lead to a speed reduction of the transfer belt 17 from the circulation speed $v_1$ to the circulation speed $v_3$ are not prevented by elaborate measures such as in the prior art; rather, the transfer belt 17 is braked to the speed $v_3$ even given load states with higher circulation speeds $v_1$ and $v_2$, or is braked to a speed lower than the speed $v_3$ during all load states.

Devices to reduce the circulation speed of the transfer belt 17 are subsequently specified in FIGS. 15 through 22. These devices thereby form the basis of the realization that conductive surfaces connected to a voltage source, to which conductive surfaces a belt-shaped material (in particular an endless belt) is directed, exert a braking force in this belt due to the generated electrostatics and thus effect a braking effect on the belt. In the devices according to FIGS. 15 through 22, this perception is used for realization of a braking arrangement via which the circulation speed of the transfer belt 17 is reduced. The braking force of the braking arrangement is thereby advantageously changed dependent on the load states, such that a constant circulation speed of the transfer belt 17 is generated given all load states.

Printing units similar to the printing units according to FIGS. 1 through 12 are shown in FIGS. 15 through 19 as well as 21 and 22. Identical elements have the same reference characters. A metal plate rounded at the edges is arranged on the inner side of the transfer belt 17, over which metal plate the transfer belt 17 is directed upon actuation of the transfer belt 17 with the aid of the drive roller 1. The metal plate 55 is supplied with a high voltage (adjustable relative to the ground potential of the printer) with the aid of a high voltage source 56 with adjustable voltage. Due to the high voltage, a braking force 58 is generated in the transfer belt 17 that directly acts on the transfer belt 17, whereby the transfer belt 17 is braked.

Figure 15:
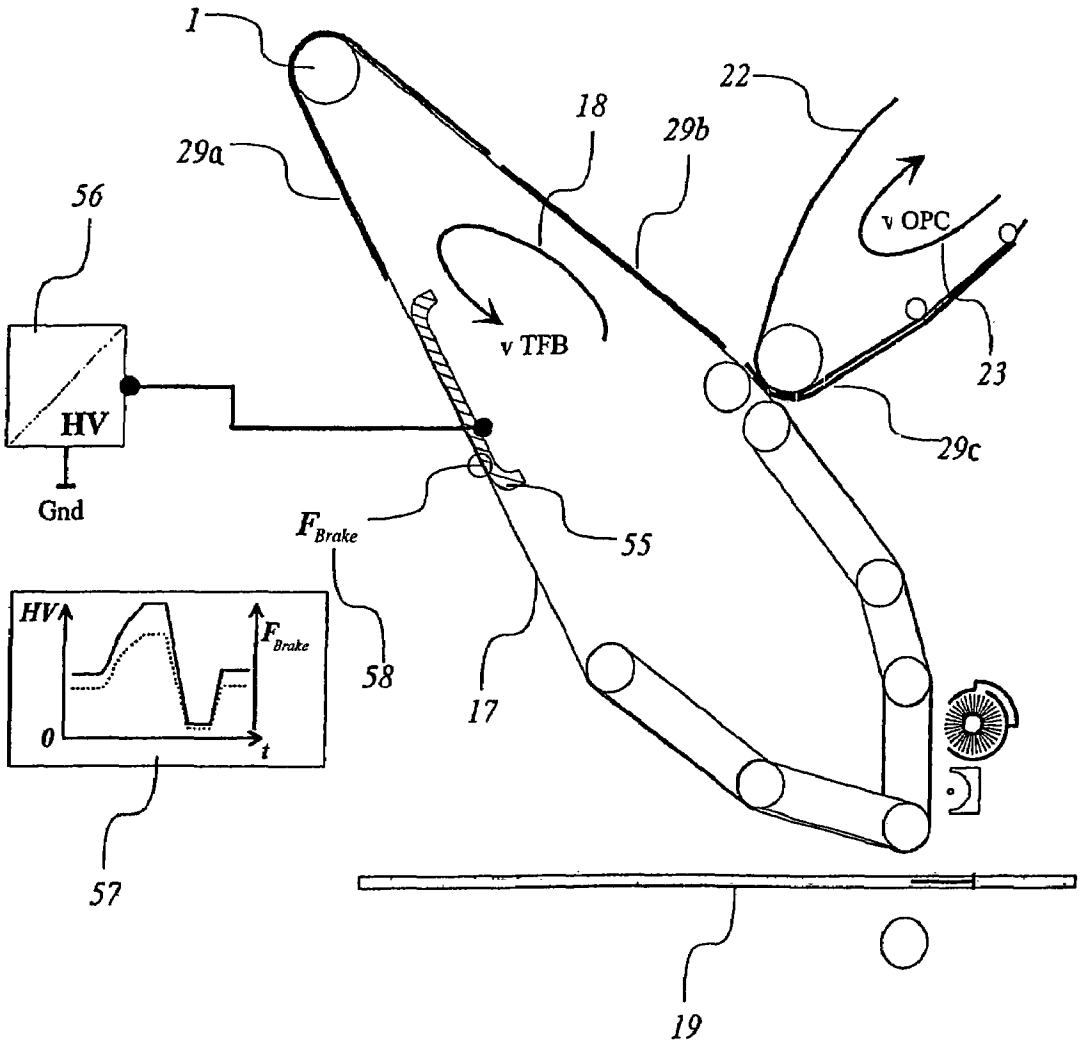
FIG. 15 is an arrangement for braking of the transfer belt according to a first embodiment of the invention.

A diagram 57 is also shown in FIG. 15 in which is shown a graph of the voltage curve of the high voltage (represented with the aid of a point line) and, with a graph shown with a solid line, the braking force (generated by the high voltage) with which the transfer belt 17 is braked. The time curve of the high voltage is controlled dependent on the different load states already described, such that an essentially constant circulation speed of the transfer belt 17 is effected. In FIG. 15, the transfer belt 17 is pivoted away from both the paper web 19 and the cleaning unit 21 such that the transfer belt 17 is braked with maximum required braking force to a constant low circulation speed $v_4$.

Figure 16:
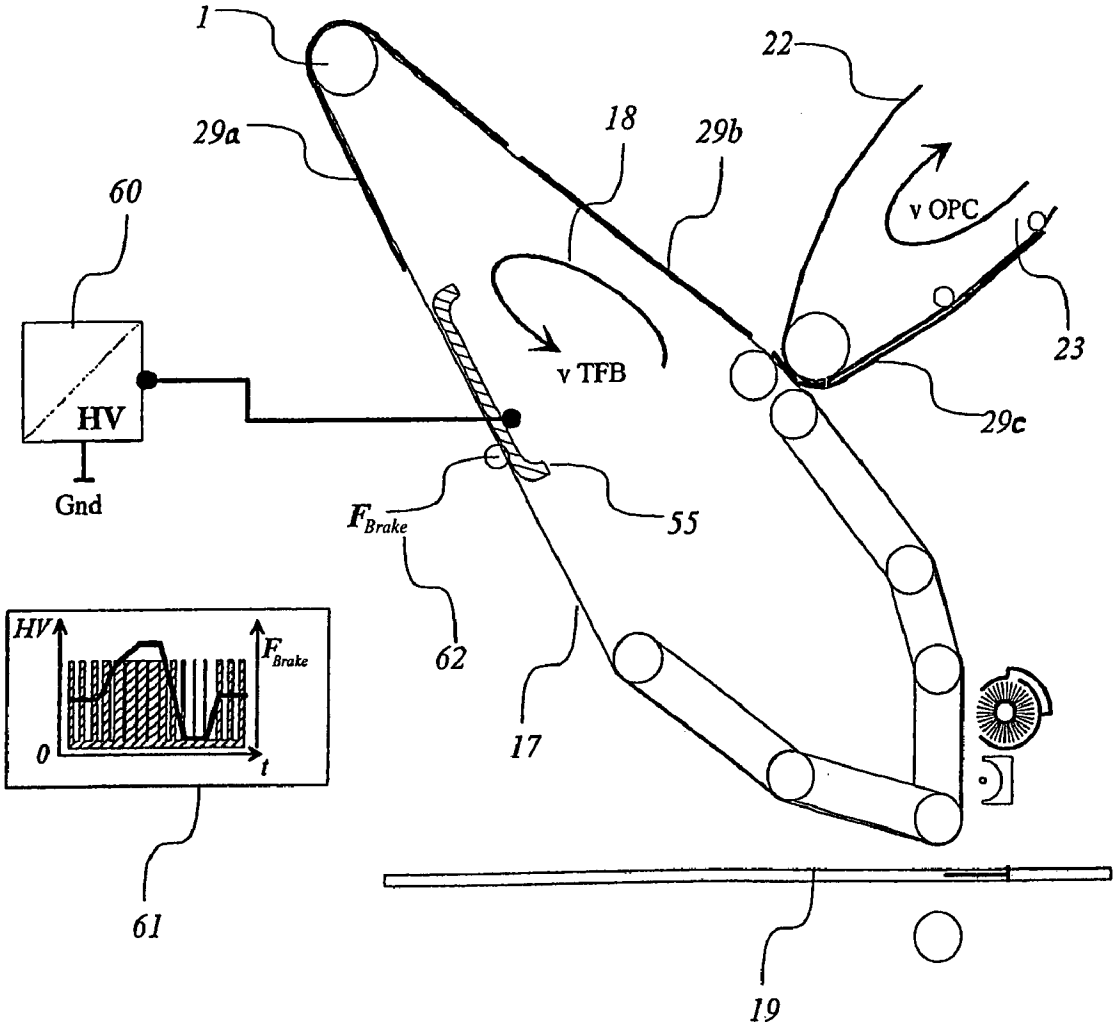
FIG. 16 is an arrangement for braking of the transfer belt according to a second embodiment of the invention.

In contrast to FIG. 15, in FIG. 16 a high voltage source with constant high voltage is provided, whereby the high voltage source 60 according to FIG. 16 supplies the high voltage to the metal plate in the form of voltage pulses of different pulse breadth or pulse width. If a greater braking force is required, the pulse widths are increased and the pauses between the individual pulses are reduced. Conversely, if a smaller braking effect is required, the pulse width of the individual pulses is reduced and the pauses between the pulses are increased. This dependency of the braking force on the pulse width is also shown in diagram 61, whereby the voltage pulses are represented by hatched surfaces and the braking force resulting from this are represented with the aid of a graph shown with a solid line.

Figure 17:
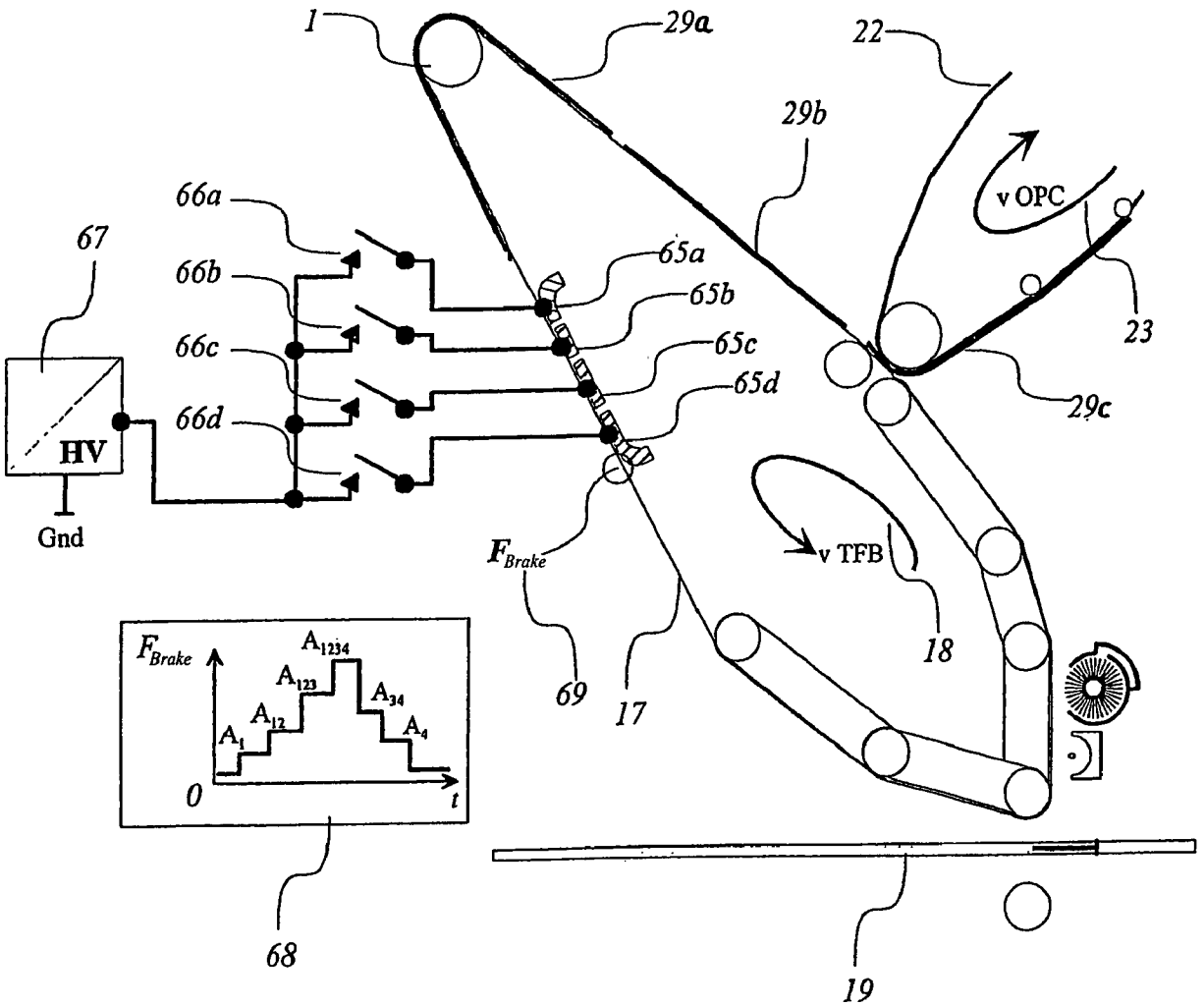
FIG. 17 is an arrangement for braking of the transfer belt according to a third embodiment of the invention.

In contrast to FIGS. 15 and 17, no metal plate 55 is provided in the printing unit shown in FIG. 17; rather a plurality of strip-shaped metal plates 65*a* through 65*d* arranged next to one another and insulated from one another are arranged in the transport direction of the transfer belt 17, to which metal plates 65*a* through 65*d* is alternately supplied a constant high voltage (generated by a high voltage source 67) via a switch 66*a* through 66*d*. The surface charged with the high voltage is thereby simply changed with the aid of the switch 66*a* through 66*d*, whereby the braking force is dependent on the effective surface charged with high voltage. The dependency of the braking force on the effective surface is likewise represented in the force-time diagram 68, whereby the metal plate 65*a* forms the areal segment A1, the metal plate 65*b* forms the areal segment A2, the metal plate 65*c* forms the areal segment A3 and the metal plate 65*d* forms the areal segment A4. The total braking force acting on the transfer belt 17 then changes dependent on the area of the individual elements, as shown in the diagram 68. The areal segments charged with high voltage are specified with the aid of the footnotes of the areal segments. Given the areal segment $A_{34}$, the metal plates 65*c* and 65*d* are thus charged with high voltage via closing of the switches 66*c* and 66*d*.

Figure 18:
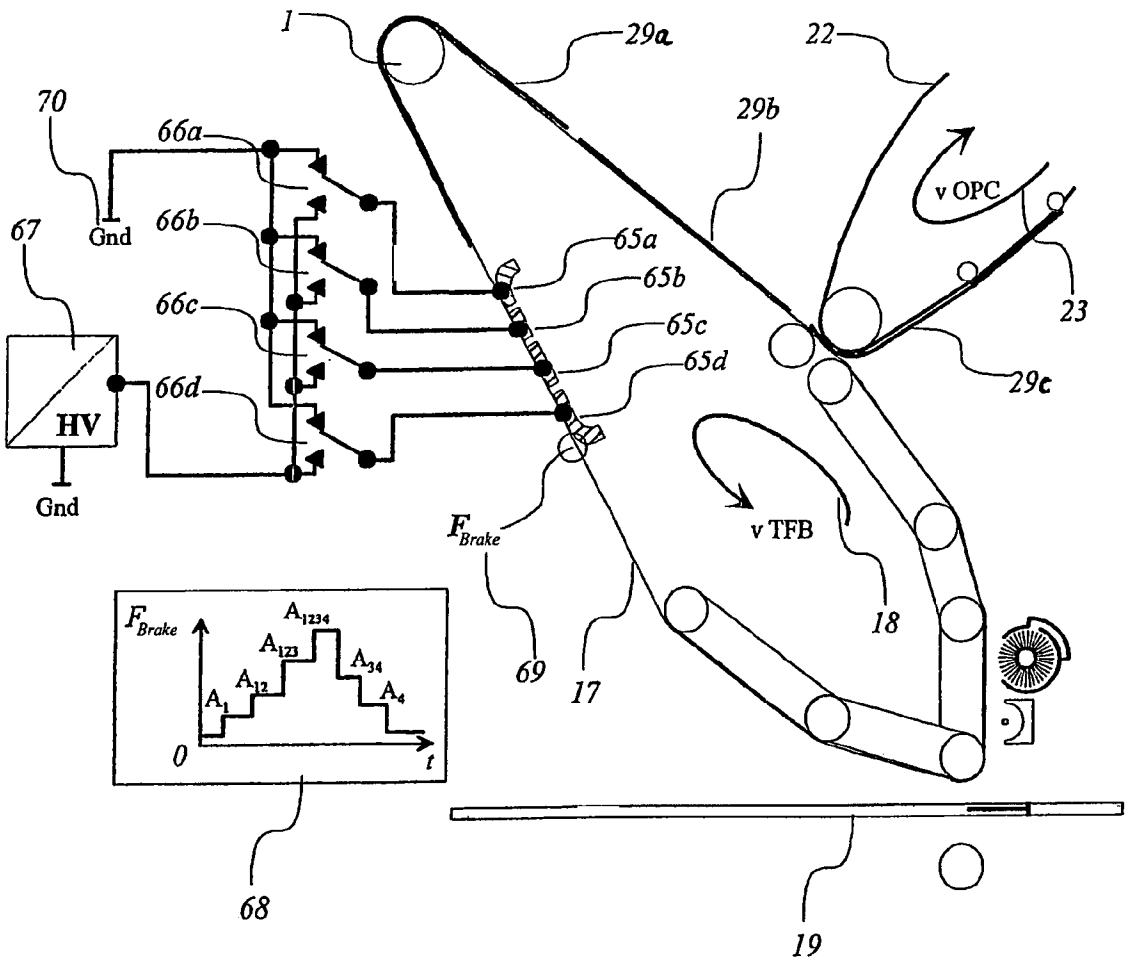
FIG. 18 is an arrangement for braking of the transfer belt according to a fourth embodiment of the invention.

The arrangement for braking the transfer belt 17 shown in FIG. 18 is similar to the arrangement according to FIG. 17, whereby given a state in which no high voltage of the high voltage source 67 is supplied to the metal plates 65*a* through 65*d*, but rather ground potential is supplied via a circuit arrangement. Floating potentials of these metal plates 65*a* through 65*d* are thereby prevented. The braking effect of this arrangement essentially coincides with the braking effect of the arrangement according to FIG. 17, as is also shown in diagram 68.

Figure 19:
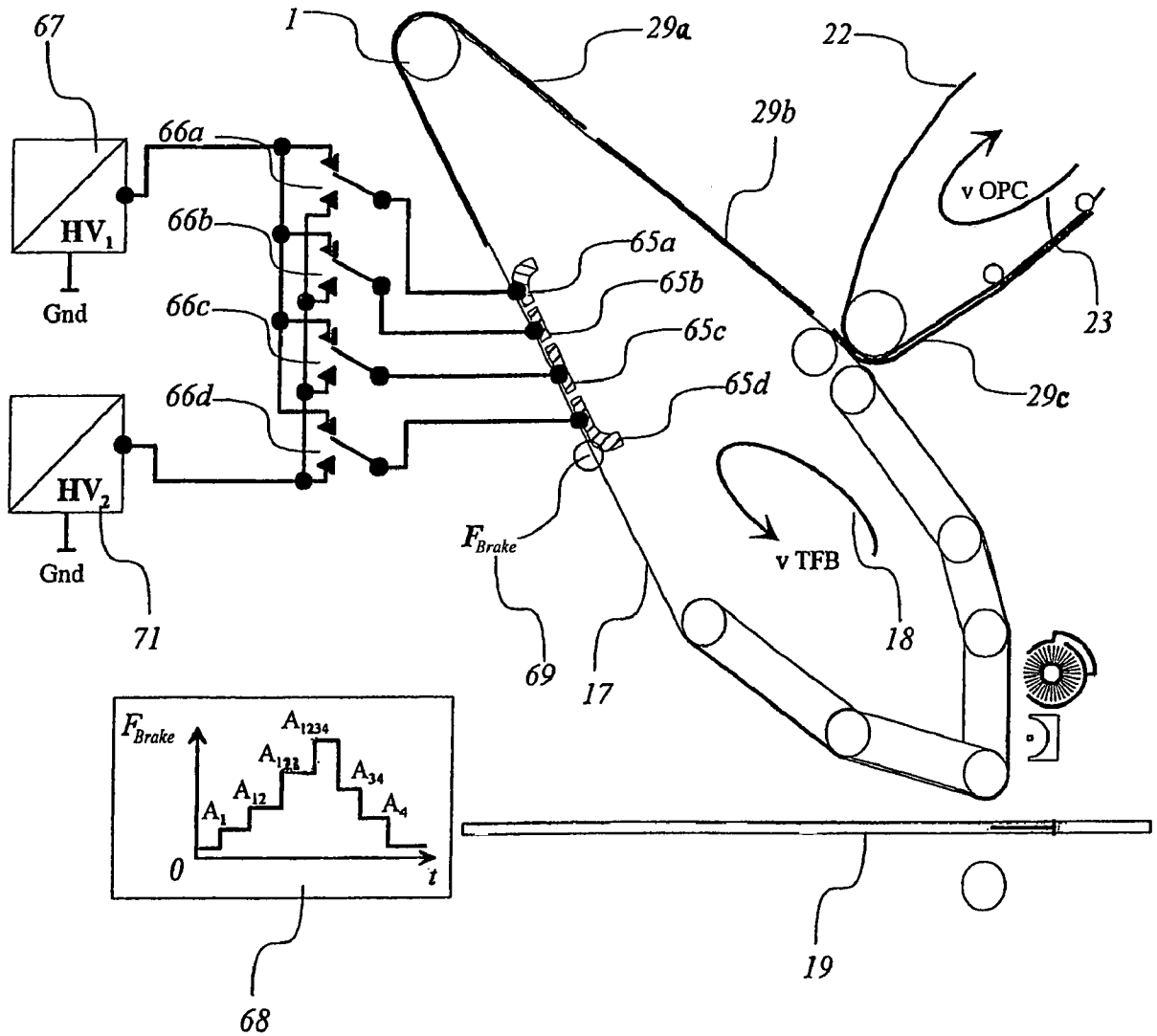
FIG. 19 is an arrangement for braking of the transfer belt according to a fifth embodiment of the invention.

An arrangement for generation of a braking force that acts directly on the transfer belt 17 is shown in FIG. 19. The arrangement of the metal plates 65*a* through 65*d* essentially coincides with the arrangement according to FIGS. 17 and 18. A first high voltage generated by a high voltage source 67 or a second high voltage generated by a high voltage source 71 can selectively be supplied to the individual metal plates 65*a* through 65*d* via the switches 66*a* through 66*d* (which are realized as change-over switches). A potential difference differing from the ground potential can thereby be generated between the individual metal plates 65*a* through 65*d*, whereby in particular one of the high voltage sources 67 and 71 can generate a high voltage negative relative to the ground potential. A braking force is generated via feeding the high voltage source 67 to the individual metal plates 65*a* through 65*d* in the same manner as in FIGS. 17 and 18, whereby the surface-dependent braking force is shown in the diagram 68 that essentially coincides with the diagrams 68 according to FIGS. 17 and 18.

Figure 20:
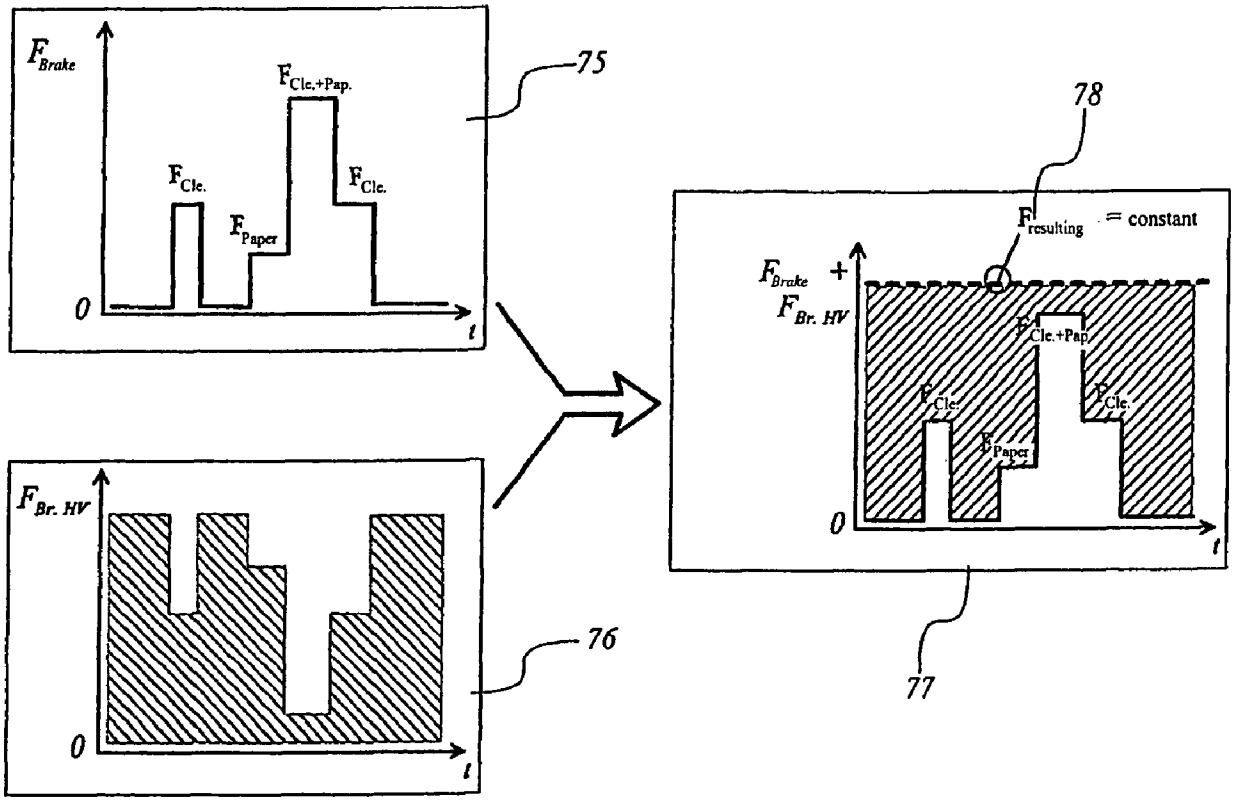
FIG. 20 shows force-time diagrams in which are represented the braking forces occurring due to the load states during the operating phases of the printer, the braking forces acting on the transfer belt due to the device for braking and the total braking forces acting on the transfer belt.

Three diagrams 75, 76 and 77 are shown in FIG. 20, whereby the braking forces active due to the different load states on the transfer belt 17 are shown in the diagram 75 and the braking force generated by one of the braking according to FIGS. 15 through 19 is shown dependent on the time in the diagram 76. A diagram 77 is also shown in FIG. 17, in which the sum of the braking forces from the diagrams 75 and 76 is shown, whereby a constant resulting braking force 78 is generated by the braking arrangement controlled dependent on load. In the diagram 75, the braking force generated by the cleaning unit 21 is designated with $F_{Cle}$, the braking force resulting due to the pivoting of the transfer belt 17 onto the paper web 19 is designated with $F_{Paper}$, the braking force generated given a pivoted transfer belt 17 on the paper web 19 and simultaneous pivoting of the transfer belt 17 onto the cleaning unit 21 is designated with $F_{Cle+Pap}$. The resulting braking force 78 can thus be held constant over the entire time span (i.e. during the various operating phases with the different load states) due to the shown braking arrangements, whereby the transfer belt 17 has a constant circulation speed. The different lengths of the toner images are thus effectively prevented. Toner images with an exact preset length are generated. Exactly congruent toner images are even generated given multi-color printing, whereby a color image fringe is prevented.

Figure 21:
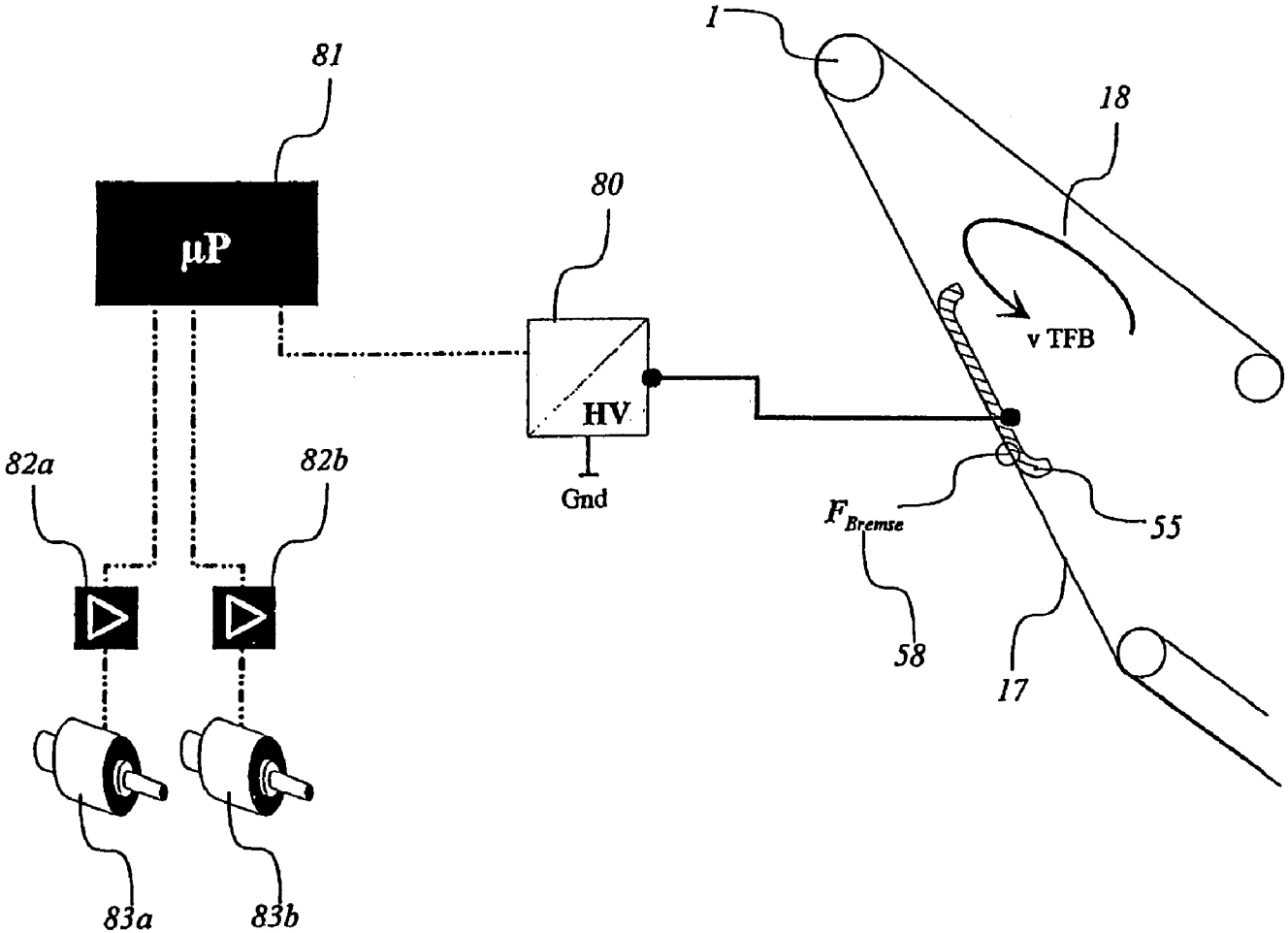
FIG. 21 is an arrangement for controlling the circulation speed of the transfer belt.

A braking arrangement according to FIGS. 15 and 16 is shown in FIG. 21, whereby (in contrast to FIGS. 15 and 16) the metal plate 55 is supplied with a high voltage generated at a high voltage source 80. The high voltage source 80 can output an adjustable variable high voltage, whereby the level of the output high voltage can be adjusted with the aid of a microprocessor 81 connected with a control input of the high voltage source 80.

The microprocessor 81 furthermore controls drive motors 83*a* and 83*b* for execution of the pivot movements of the transfer belt 17 onto the cleaning unit 21 and onto the paper web 19 with the aid of the lever mechanism of the levers 6, 8, 10, 12, 15. The outputs of the microprocessor 81 for activation of the drive motors 83*a* and 83*b* are connected with power converters 82*a*, 82*b* that convert the control signals of the microprocessor 81 into motor activation signals for activation of the motors 83*a* and 83*b*, whereby the motors 83*a* and 83*b* are advantageously step motors. The motor 83*a* thereby executes a pivot movement of the lever 6 and the motor 83*b* executes a pivot movement of the lever 10. The same microprocessor 81 thereby controls high voltage generating the braking effect and the pivot movement of the transfer belt 17. The load changes generated by the pivot movements can thus very simply be taken into account in the determination of the high voltage to be set and the braking force resulting from this, whereby a corresponding change of the braking force effected by the metal plate is be generated at the same point in time at which a load change occurs (or, in the event that it is necessary, before this point in time) in order to ensure the constant braking force 78 shown in FIG. 20.

Figure 22:
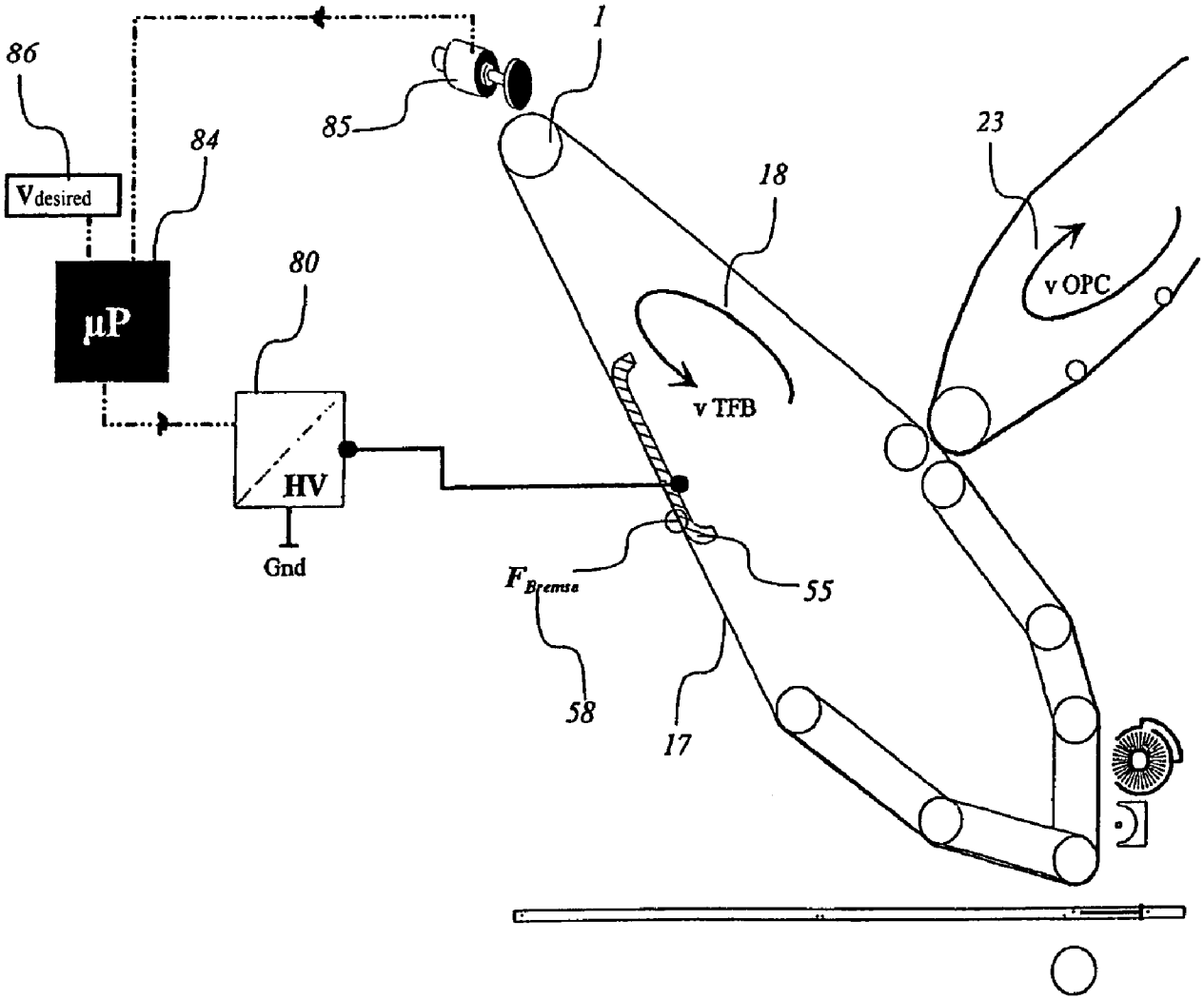
FIG. 22 is an arrangement for regulating the circulation speed of the transfer belt.

The braking arrangement according to FIG. 21 is shown in FIG. 22, whereby the high voltage source 80 is activated by a microprocessor 84 to which a desired value 86 of the circulation speed of the transfer belt 17 is supplied and to which a real value of the circulation speed is supplied with the aid of a sensor 85 to detect the circulation speed of the transfer belt 17. As an alternative to the velocity sensor 85, the circulation time of the transfer belt 17 can also be detected with the aid of a suitable sensor arrangement from which the circulation speed is then simply determined with the aid of the belt length of the endless belt. The microprocessor 84 implements a real value-desired value comparison and, dependent on the control deviation, generates a control signal that supplies the high voltage source 80 to the microprocessor 84. The high voltage source 80 thus serves as a control element of the control loop.

Figure 23A:
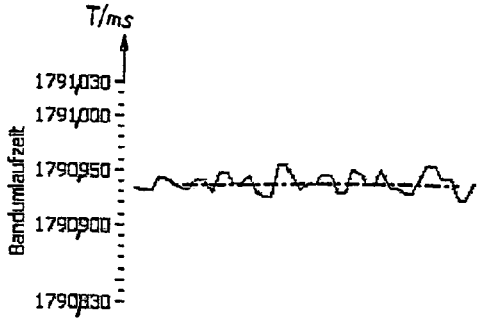
FIGS. 23*a* through 23*e* show the change of the circulation speed of the transfer belt give constant drive speed and different braking voltages according to the first embodiment of the invention according to the device according to FIG. 15.
Figure 23B:
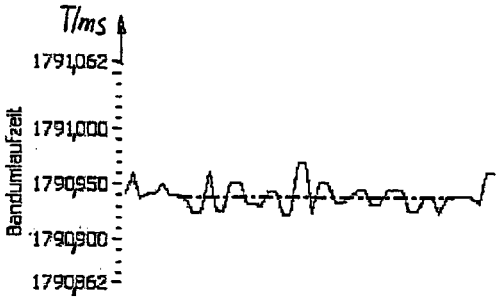

The circulation times of the transfer belt 17 are respectively shown in FIGS. 23*a* through 23*e* dependent on the set direct voltage. The effective surface of the metal plate 55 is thereby 545 $cm^2$, whereby the circulation speed $v_1$ is only 992 mm/s at a high voltage of 0 kV. The average circulation time is respectively shown in FIGS. 23*a* through 23*e* with the aid of a dash-dot line. As already mentioned, in FIG. 23*a* no high voltage is applied to the metal plate 55; rather, ground potential or a potential corresponding to ground potential is applied. The average belt circulation time is 1790.94 ms. A diagram is shown in FIG. 23*b* in which the circulation time of the transfer belt 17 occurs given a charging of the metal plate 55 with a high voltage of 0.4 kV. The average circulation time of the transfer belt 17 is thereby likewise 1790.94 ms.

Figure 23C:
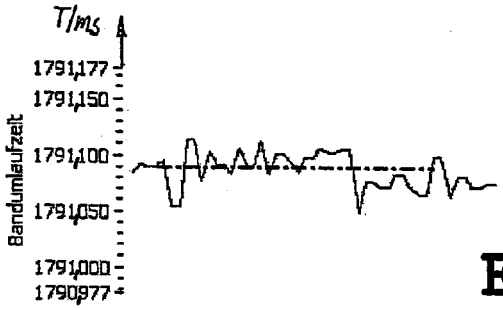
Figure 23D:
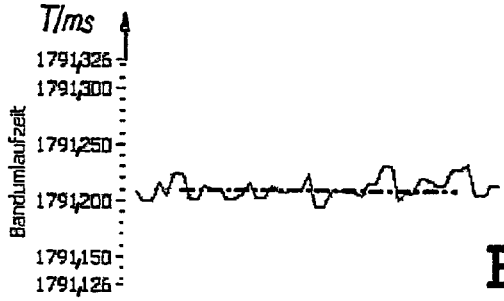
Figure 23E:
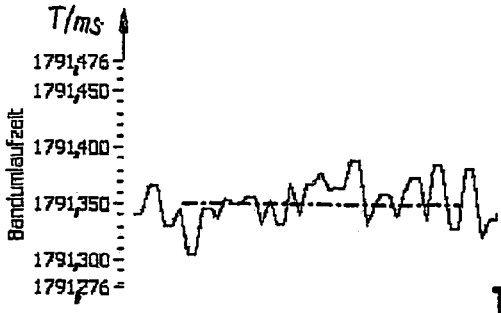

The circulation time of the transfer belt 17 is shown in FIG. 23*c* given a charging of the metal plate 55 with a high voltage of 0.80 kV. The circulation time of the transfer belt 17 is thereby on average 1791.09 ms. The circulation time of the transfer belt 17 given a charging of the metal plate 55 with a voltage of 1.2 kV is shown in FIG. 23*d*. The average circulation time is thereby 1791.21 ms. Given a charging of the metal plate 55 with a voltage of 1.6 kV, the average circulation time of the transfer belt 17 is 1791.35 ms, as shown in FIG. 23*e*.

Figure 24:
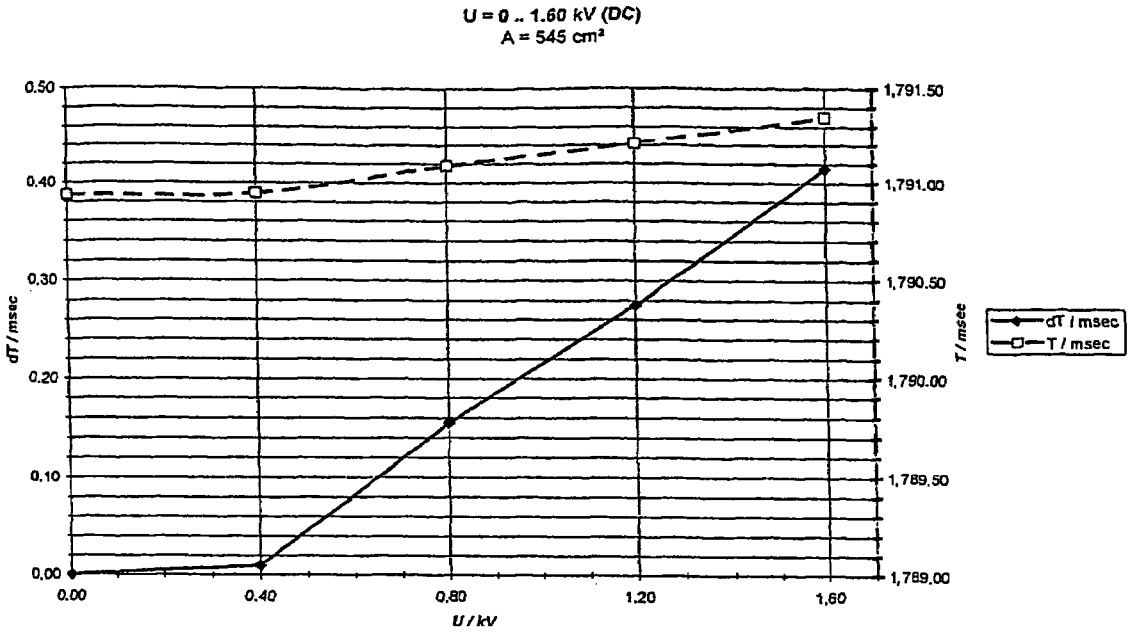
FIG. 24 shows a circulation time/circulation speed-voltage diagram in which the change of the circulation time and of the circulation speed is shown dependent on the applied voltage.

A circulation time/circulation speed-voltage diagram is shown in FIG. 24, in which the change of the absolute circulation time and the change in the circulation time is represented dependent on the change of the supplied voltage. The graph represented with the aid of a dashed line thereby specifies the variation of the absolute circulation time, and the graph represented with the aid of a solid line specifies the change of the circulation time with increasing voltage. The metal plate 55 or the metal plates 65*a* through 65*d* are arranged on the inner side of the transfer belt 17 in the exemplary embodiments.

The braking effect on the transfer belt 17 may be based on the fact that an electrical field through which the transfer belt 17 is directed is generated between the metal plate 55 or the metal plates 65*a* through 65*d* and the components of the printer that have a potential differing from the potential of the metal plate 55, 65*a* through 65*d*. The metal plate 55, 65*a* through 65*d* is thus a capacitor plate. The electrical field effects a temporary displacement of charges in the transfer belt 17. Due to the displacement, a concentration of charges opposite the charge of the capacitor plate occurs in the transfer belt 17 towards the metal plate 55, 65*a* through 65*d*. The charges in the transfer belt 17 are thereby attracted by the charge of the capacitor plate 55, 65*a* through 65*d* with a force according to Coulomb's Law. Due to this force, the transfer belt 17 is drawn in the direction of or against the metal plate 55, 65*a* through 65*d* (i.e. capacitor plate), whereby, given a contact between the metal plate 55, 65*a* through 65*d* and the transfer belt 17, depending on the size of this attractive force a friction force is generated between metal plate 55, 65*a* through 65*d* and transfer belt 17 that reduces the transport speed. A braking force independent of the rollers of the belt drive is thereby generated that acts directly on the transfer belt 17. A further metal plate can also be arranged on the side of the transfer belt 17 opposite the metal plate 55, 65*a* through 65*d*, essentially in parallel with the metal plate 55, 65*a* through 65*d*, at a preset distance from the transfer belt. To generate the braking force, the further metal plate then has a potential (advantageously ground potential) differing from the potential of the metal plate 55, 65*a* through 65*d*.

In other exemplary embodiments, the metal plate 55, 65*a* through 65*d* can also be arranged on the outer side of the transfer belt 17 at a distance from the transfer belt 17, such that a toner image located on the transfer belt 17 is not damaged by the metal plates 55, 65*a* through 65*d*. As an alternative to a direct voltage, the high voltage sources 56, 60, 67, 71 can also generate an alternating voltage with which the plates 55, 65*a* through 65*d* are charged. The braking force generated via the feed of the high voltage acts directly and without temporal delay on the transfer belt 17. A very exact and time-precise control of the braking force is thereby possible. The metal plates 65*a* through 65*d*, 55 advantageously extend over the entire width of the transfer belt 17. Due to the inventive braking arrangements, the transfer belt 17 and the plates 55, 65*a* through 65*d* are subject to only very slight wear.

As an alternative to the shown embodiments, the surface generating the braking force can also be divided up into segments transverse to the transfer belt 17 that can be charged individually or in groups with high voltage of the same voltage level or different voltage levels. The metal plates 55, 65*a* through 65*d* are metal plates that contain a stainless steel alloy, copper or a copper alloy or that contain an aluminum alloy or aluminum. The plates can also be subjected to a surface treatment or be provided with a coating. Alternatively, electrically-conductive plastics can also be used as a plate 55. The plates 55 are advantageously provided with a smooth surface or with a suitable surface structure. Further variations of the regulation (for example the detection of the real value of the circulation speed with the aid of the circulation time) of a desired value specification controlled by a further process are possible in order to realize inventive applications. The braking arrangement of the preferred embodiment was provided in the shown exemplary embodiments for braking of the transfer belt 17. However, such a braking arrangement for braking of the photoconductor belt 22 or further belt-shaped carrier material is also possible, whereby the endless carrier material does not necessarily have to be an endless, circulating belt. Rather, the belt 17 to be braked can also be a paper web or single sheets with a relatively large length.

Although a preferred exemplary embodiment with various modifications been shown and described in detail in the drawings and in the preceding specification, it should be viewed as purely exemplary and not as limiting the invention. It is noted that only the preferred exemplary embodiment is shown and described, and all variations and modifications that presently and in the future lie within the protective scope of the invention should be protected.

I claim as my invention:

1. A method for control of circulation speed of an endless belt arranged in a printer or copier, comprising the steps of:

directing the endless belt over at least two rollers where the belt is driven with a preset first circulation speed via at least one of the rollers as a driven roller, various load states acting on the endless belt in successive operating phases during a printing or copying process, and via said various load states the belt being braked with different strengths so that a slippage is generated at least between the belt and the driven roller;

generating a braking force acting directly on the endless belt; and controlling the braking force such that a substantially constant slippage is generated between the driven roller and the belt based on the operating phases so that the endless belt is braked to a second circulation speed.

2. A method according to claim 1 wherein the endless belt comprises a photoconductor belt or a transfer belt.

3. A method according to claim 1 wherein the operating phases are generated via a pivoting of the endless belt onto and off of a carrier material, an activation of a cleaning device, or an activation of charge devices.

4. A method according to claim 1 wherein a resulting circulation speed is the second circulation speed, whereby the second circulation speed is constant in all operating phases.

5. A method according to claim 1 wherein the endless belt is directed past an electrically-conductive surface aligned substantially parallel to the endless belt, and a voltage is applied to the surface.

6. A method according to claim 5 wherein the applied voltage comprises a potential difference relative to a ground potential.

7. A method according to claim 5 wherein a surface of at least one of the rollers has ground potential.

8. A method according to claim 5 wherein the endless belt contains at least one high-ohmic conductive layer.

9. A method according to claim 5 wherein the voltage has a value in a range between 200 and 3000 volts.

10. A method according to claim 1 wherein the braking force is adjusted with aid of a control loop to regulate the circulation speed.

11. A method according to claim 5 wherein the braking force is adjusted with aid of a level of the applied voltage.

12. A method according to claim 5 wherein the braking force is adjusted with aid of a pulsed voltage according to pulse width modulation.

13. A method according to claim 1 wherein the braking force is controlled via charging a surface of the belt with the voltage.

14. A method according to claim 1 wherein a plurality of surfaces are provided arranged substantially parallel to the belt, said surfaces being selectively charged with a potential differing from a ground potential.

15. A method according to claim 14 wherein the surfaces are arranged on an inner side of the endless belt.

16. A method according to claim 1 wherein the braking force is controlled dependent on a load of the endless belt caused by operating states, the braking force being controlled dependent on control points in time.

17. An arrangement for controlling circulation speed of an endless belt arranged in a printer or copier, comprising:

an endless belt directed over at least two rollers;

a drive unit that drives the belt with a preset first circulation speed via at least one of the rollers as a driven roller;

a control unit which controls the printing or copying process, various load states acting on the endless belt, and via said various load states the belt being braked with different strengths so that a slippage occurs at least between the belt and the driven roller;

a braking unit that generates a braking force that acts directly on the belt; and the control unit controlling the braking force such that a substantially constant slippage occurs between the driven roller and the belt based on the operating phases so that the endless belt is braked to a second circulation speed.

18. A method for control of circulation speed of an endless belt arranged in a printer or copier, comprising the steps of:

directing the endless belt over at least one roller where the belt is driven with a preset first circulation speed via the at least one roller as a driven roller, various load states acting on the endless belt during operation, and via said various load states the belt being braked with different strengths so that a slippage is generated at least between the belt and the driven roller;

generating a braking force acting on the endless belt; and controlling the braking force such that a substantially constant slippage is generated between the driven roller and the belt during operation so that the endless belt is braked to a second circulation speed.

19. An arrangement for controlling circulation speed of an endless belt arranged in a printer or copier, comprising:

an endless belt directed over at least one roller;

a drive unit that drives the belt with a first circulation speed via the at least one roller as a driven roller;

a control unit which controls various load states acting on the endless belt during operation, and via said various load states the belt being braked with different strengths so that a slippage occurs at least between the belt and the driven roller;

a braking unit that generates a braking force that acts on the belt; and the control unit controlling the braking force such that a substantially constant slippage occurs between the driven roller and the belt during operation so that the endless belt is braked to a second circulation speed.

* * * * *